US011261673B2

(12) United States Patent
Martin

(10) Patent No.: US 11,261,673 B2
(45) Date of Patent: Mar. 1, 2022

(54) STABILIZER FOR INHIBITING SUCKER ROD BUCKLING DURING COMPRESSION MOMENTS IN ARTIFICIAL LIFT WELLS

(71) Applicant: BLACK MAMBA ROD LIFT COMPANY DURING COMPRESSION MOMENTS IN ARTIFICIAL LIFT WELLS, Edmond, OK (US)

(72) Inventor: Jonathan R. Martin, Edmond, OK (US)

(73) Assignee: Black Mamba Rod Lift LLC, Oklahoma City, OK (US)

( * ) Notice: Subject to any disclaimer, the term of this patent is extended or adjusted under 35 U.S.C. 154(b) by 0 days.

(21) Appl. No.: 16/875,988

(22) Filed: May 16, 2020

(65) Prior Publication Data

US 2021/0348453 A1 Nov. 11, 2021

Related U.S. Application Data

(63) Continuation-in-part of application No. 62/848,189, filed on May 15, 2019.

(51) Int. Cl.
*E21B 17/10* (2006.01)
*E21B 43/12* (2006.01)

(52) U.S. Cl.
CPC ..... *E21B 17/1071* (2013.01); *E21B 43/127* (2013.01)

(58) Field of Classification Search
CPC ..... E21B 17/00; E21B 17/10; E21B 17/1057; E21B 17/1071; E21B 17/22; E21B 43/127
See application file for complete search history.

(56) References Cited

U.S. PATENT DOCUMENTS 3,083,772 A * 4/1963 Tripplehorn ..... E21B 37/02 166/176
3,560,060 A * 2/1971 Morris ..... E21B 17/1071 166/241.4

* cited by examiner

*Primary Examiner* — David Carroll
(74) *Attorney, Agent, or Firm* — Phillip Free Law, PLLC

(57) ABSTRACT

A helical solid profile attached and originating from the outer diameter of a composite or steel sucker rod and extending approximately to the inner diameter of the production tubing, running axially along the sucker rod body and affixed to it for reinforcement and stabilization of the sucker rod tension member body in axial alignment to the central axis of the production tubing which the sucker rod member is housed in, whereas the helical solid profile is made of material which is for acceptable use within the production system environment, the helical solid profile purpose being to control and reduce the sucker rod's deflection during compressive moments, extending the life of the sucker rod or reduction in stress and erratic buckling cycles.

25 Claims, 14 Drawing Sheets

STABILIZER FOR INHIBITING SUCKER ROD BUCKLING DURING COMPRESSION MOMENTS IN ARTIFICIAL LIFT WELLS

CROSS-REFERENCE TO RELATED APPLICATIONS

The present application is a continuation-in-part application of, and claims priority to, U.S. Provisional Patent Application Ser. No. 62/848,189, filed May 15, 2019, invented by Jonathan R. Martin, and entitled "Stabilization Tool For Use In Inhibiting Sucker Rod Buckling During Compression Moments In Artificial Lift Wells."

TECHNICAL FIELD OF THE INVENTION

The present invention relates in general to sucker rods for down-hole well pumps, artificially lifting fluid from wells, and in particular to sucker rod guides and centralizers which prevent sucker rod buckling, bending moments and premature failure at the ends of mold-on centralizers, and premature sucker rod failure.

BACKGROUND OF THE INVENTION

Sucker rods, utilized in pumping oil wells, have had little innovation over the last 75 years. The majority of sucker rods are made from steel, with some formed of composite materials. Steel sucker rods have upsets forged on the ends which are machined to shape and to create threads for co-joining multiple sucker rods at well installation by use of internally threaded sucker rod couplings. Sucker rods connect the surface pumping unit which moves up and down, to the down-hole pump, which also moves up and down. The sucker rods are contained inside the production tubing, which the production fluid, predominately a mixture of oil and water, flows up through on its way to the surface. Sucker rods are also used in progressive cavity pumping systems as a rotating shaft from the surface to the down-hole progressive cavity pump. Sucker rods are expected to be lifted by the surface pumping unit, lifting the weight of the rods and the weight of the fluid together. On the downstroke, the rods are expected to fall through the fluid under their own weight through the fluid and to remain in tension. Sucker rods preferably have small tension loads on the down-stroke of the pumping unit as they are suspended in the fluid column under gravity and their own weight and high-tension loads on the upstroke due to lifting the weight of the rods themselves, combined with the weight of the fluid column as fluid is lifted to the surface.

During use, sucker rods are cycled upward and downward within production tubing to pull fluids from within wells. During the lifting part of the cyclical motion, sucker rods are exposed to peak lifting loads comprised of: the weight of the sucker rod string at a point on the sucker rod being evaluated, the summation of the sucker rod string buoyant weight below it, the total weight of the fluid column which acts on the plunger surface area of the downhole pump, inertia loads from the deceleration of the sucker rod string as it reverses direction from a downward motion to an upward motion during the cycle of the pumping unit, and any friction or drag loads where the tubing wants to oppose or restrict the motion of the sucker rod string moving in the upward direction. In the lowering of the sucker rod string during half of the cycle of the surface pumping unit, the sucker rods are intended to stay in tension through gravity loads. The load applied to a sucker rod in the downward motion is comprised of: the weight of the sucker rod string at a point on the sucker rod being evaluated and the summation of the sucker rod string buoyant weight below it, inertia loads from the deceleration of the sucker rod string as it reverses direction from an upward motion to a downward portion of the cycle of the pumping unit, and the summation of any friction or drag loads where the tubing wants to oppose the motion of the sucker rod string moving in the downward direction. During the release of the fluid load at the peak of the sucker rod string motion, there is an inertia effect on the sucker rod string which applies negative loading on the sucker rods resulting in a 'neutral point' in the sucker rod string. This neutral point location is found by solving for the inertia-based negative loading being equal to the location in the rod string where the buoyant weight and gravity load of the sucker rod string are equal. At the neutral point and below to the down-hole pump, the sucker rod string transitions into compression rather than remaining in tension.

Other well dynamics, such as intended pump tagging (the down-hole pump finds bottom and is 'stroked-in' before the sucker rod string achieves peak bottom of the downward motion in the cyclical motion), inertia strain from the deceleration of the sucker rod string as it reverses direction from a downward motion to an upward motion, stuck pumps from trash, deviation, among other things, can also induce compression loads into the sucker rod string much further up the sucker rod string assembly. At the workover rig during system assembly of the sucker rods and the down-hole pump within the well, the rig operator will momentarily lower the rods through the tubing to apply a significant load on the down-hole pump, attached to the lowest sucker rod, stabilizer bar (short length, large diameter rods with sucker rod centralizers), or sinker bar (heavy, large diameter sucker rods) so the down-hole pump can be 'seated' in the seating nipple at the bottom of the well, locking the down-hole pump in place during operation of the well. This is pure compressive loading on the down-hole pump through the rod string, which makes the rods buckle within the tubing at installation. Compression within the rod string is inevitable and sometimes applied intentionally, potentially leading to micro-cracks in the surface of the steel sucker rod body for propagation and pre-mature failure. Compressive loads applied to sucker rods with centralizers lead to an increase in stress at the edges of the centralizer, sometimes beyond the yield strength of the sucker rod. This, applied in cyclical patterns, will inevitably lead to microcracks in the surface of the sucker rod, further propagating and leading to sucker rod failure. Pump tagging also occurs. Pump "tagging" is purposefully bottoming out the pump and inducing compression on the rod string, which is a common industry practice. The industry has a phrase, "If it ain't bumpin', it ain't pumpin'." This phrase relates to tagging the pump, which has benefits for pump performance but is detrimental to the sucker rod string. Regardless of best pumping practices in application of beam-lift production wells, nature and the chaotic, uncontrollable nature of solids (sand, typically) flowing into the down-hole pump, in addition to intermittent trapped gas or lack of fluid intake, all lead collectively to guaranteed compressive stress in the rod string.

Through deep, deviated or horizontal well-bores, tubing is not straight and therefore the rod string travels through twists, bends, and turns (deviation from vertical) which often creates compression moments during the actuation of the sucker rods. Other drivers of compressive moments on the sucker rod string come from gas or fluid pounding, pump tagging (the down-hole pump finds bottom and is 'stroked-in' before the sucker rod string achieves peak bottom of the downward motion in the sinusoidal motion), slug flow (chaotic gas/liquid fluid intake at the pump), pump friction, or cycling the pumping unit too quickly, among other reasons. These compressive moments on long slender columns, the sucker rods, make the sucker rod unstable and therefore the sucker rod buckles within the production tubing. The buckling action of the sucker rod then creates momentary high stresses which the sucker rod was not designed for, causing damage to the sucker rods and the tubing itself. Repetitive buckling within the well then creates sucker rod failures through cracks in the surface from repetitive high-tensile surface stress and accelerated time to fatigue failure.

FIG. 15 is a side elevation view of a sucker rod have a central portion which is centered within production tubing during buckling. Bending of the sucker rod adjacent to the conventional centralizer, while the conventional centralizer retains the central portion in a fixed coaxial relation with the production tubing, results in his point stress adjacent to the centralizer. Stresses are concentrated as points C1, C2, T1 and T2. T1 and T2 are shown as tensile loads and C1 and C2 are compressive loads. The loads will be applied cyclically with each stroke of the rod pump.

During buckling or compression, once the slender column becomes unstable and buckles due to the eclipsing of Euler's critical buckling load, monumental stresses are created which can exceed the yield strength of the steel. This instability and stress are only present because the buckling behavior is allowed and the sucker rod is so rigidly forced to the center of the tubing. This happens because the four-fin design is axially forcing alignment to the center of the tubing.

By using the helical design of a stabilizer of the present disclosure, we are only forcing the rod to the center of the tubing from one vector/direction at a time. Therefore, the rod is completely centralized; however, it is allowed to flex as necessary if axial deflection is required (buckling). This unique design eliminates and relieves the typical failure mode of such rods which happens at the edges of traditional sucker rod guide due to this peak stress area. Corrosion, fluid turbulence, erosion with solids swirling on the rod, all play a part in the accelerated fatigue and failure of the sucker rod at the edge of the rod guide. The single helical fin wrap of the present disclosure allows for four time the fluid flow area in comparison to the traditional four-fin design. The fluid turbulence is non-existent, again relieving another failure mode on traditional sucker rod and four-fin sucker rod guide systems.

These compressive loads and resulting bending moments are attempted to be controlled through strategic programming and closed-loop control systems at the surface with the pumping unit. There has long been a need to address sucker rod string protection and address sucker rod string compression, bending moments, and accelerated fatigue failures along the sucker rod string. In evaluating failures of sucker rod systems from individual wells, industry failure analysis experts encounter hundreds of well failures every single day as a result of accelerated fatigue and bending moments at the forged upset transition and at the edges of the sucker rod centralizers or guides caused by compressive loads and the resulting buckling of the sucker rods string.

Operators, individuals, and engineers have long seen the need to help stabilize and centralize the steel sucker rod within the steel tubing, preventing steel-on-steel rubbing, contact, and wear. In operation, sucker rods can rub against the steel tubing and wear a hole in the tubing or wear through the sucker rod itself, also leading to pre-mature product failure, putting the well offline and therefore no longer producing fluids until the well has been serviced and repaired. Rod centralizers began as steel welded paddles and scrapers for movement of paraffin and isolation of the sucker rod from the production tubing. Molded polymer sucker rod guides and centralizers have since become the go-to solution for alleviation of this metal on metal wear, typically comprising of multiple vanes, 2-vanes or more (usually 4 vanes), to force the rod centrally in the tubing. Conventional sucker rod centralizers have evolved to thermoplastic and thermoset polymeric materials molded to shape directly on to the sucker rod, in addition to stand-alone components which can be attached to the sucker rod in the field. These various options provide an excellent remedy when the sucker rods are in tension and remain in tension within the well during installation and operation of the well. However, compression moments occur in sucker rods during use in oil wells.

Sucker rods under compressive loads can buckle, creating bending moments at the forged upset transition and at the ends of sucker rod centralizers. The bending moments occur cyclically, accelerating sucker rod fatigue, leading to failure. The sucker rod's axial exterior surface during compression while buckling contact the production tubing between the sucker rod centralizers causing wear of the tubing and the sucker rods. These compressive moments also induce a negative load on the sucker rod, a long slender diametric rod, to which the sucker rod then buckles within the tubing. This buckling applies significant side-loads of sucker rod into tubing, flexing the rod. The buckling action creates bending moments at rigid sections of the sucker rod, such as at the forged upset transition at the ends of the sucker rods, leading to a drastic increase in stress and acceleration of fatigue on the sucker rod. The use of traditional sucker rod guides having 2-vanes or more, generally in a longitudinal direction, radially extending from the sucker rod body to the inner surface of the production tubing, centralize the rod in the production tubing in a rigid manner, provide additional bending moments along the rod, decreasing rod life, ultimately leading to pre-mature failure of the sucker rod.

FIG. 16 is a graph of stress versus time for a sucker rod, depicting expected rod stress and actual compressive stress occurring at conventional rod guides. FIG. 17 is a graph of rod load exported from finite element analysis during the study of buckling behavior of sucker rods and the influence of stress due to the use of standard, multi-fin sucker rod centralizers. The expected rod stress is shown, along with actual stress computed due to the buckling behavior between the sucker rod centralizers. This buckling behavior creates tension on one side of the rod, and compression on the other, as the rod flexes and bows outward into the tubing. The plot shown shows expected stress if buckling was not a factor, versus the actual tension and compression nodal analysis at the edge of the rod guide. If the sucker rods flex and feature a bending moment at the edge of a rod guide or forged transition, the computed negative stress values on the sucker rod string are rendered inaccurate instantly so. For instance, the flexing and bending from a bending moment can increase the stress along the sucker rod body both as positive and negative stress, upwards of four times the calculated normal stress that would occur if there was no bending moment.

Under compressive loads and resulting bending moments, sucker rod guides and centralizers do more harm than good for the sucker rod itself. The rod is forced into the middle of the tubing at the centralizer or guide; however, the sucker rod buckles between the rod guides due to constraint to the middle of the tubing because of sucker rod isolation from the four fins. This buckling action then creates extreme stresses and bending moments at the edges of the guides. Time and time again sucker rods fail at the edge of a sucker rod guide or at the start of the forged upset transition on the sucker rod because of these bending moments and compression.

A sucker rod may have longer life without the use of sucker rod guides if it is experiencing regular compressive loading eclipsing the critical buckling load for the long slender column of a sucker rod. Verified by physics and engineering work, if the sucker rod is experiencing compressive loads greater than its mathematical allowance and is buckling between guides, more rod guides are needed to prevent sucker rod buckling, or the alternative is no-rod guides which will reduce the bending moments and stress on the rod, but increase the rod-on-tubing wear. If more guides are elected to be added to sucker rods, they must be able to eclipse the compressive loads the sucker rod is experiencing, otherwise the additional rod guides are increasing the stress values at the edges of the rod guides, and the rod will fail that much quicker. Electing to use less or no sucker rod guides, the steel tubing and rod however will experience wear due to no isolation and centralization of the sucker rod on the tension upstroke.

Buckling and compression both create stress concentrations from bending moments which lead to a failure in the rod string, typically what is called a 'rod part' in industry for steel rods. This is where the rod breaks from accelerated fatigue due to the bending moments creating extreme negative stress (compression) and positive stress, cyclically, between the standard upstroke tensile stress. This results in a larger negative stress ratio, which is detrimental to fatigue life. By limiting exponential increase in tension stress on the sucker rod body due to buckling, the fatigue life of the sucker rod is instantly increased, as shown by physics and S-N Diagrams for material science. Limiting this stress ratio is possible by isolation of the sucker rod within the tubing, preventing buckling and creating a pure, normal stress on the rod, limiting its buckling deflection and drastically reducing or eliminating the erratic surface stress on the sucker rod body. This is accomplished by way of reinforcing the sucker rod to the center of the tubing to where it is unable to buckle. This could be done by way of adding more and more traditional centralizers to the sucker rod (not an economically feasible option) or by use of the invention discussed herein. Prevention of sucker rod buckling is a dramatic improvement to the system, leading to lengthened operational life never before seen in the industry.

Compression and buckling failures on composite sucker rods (carbon fiber or fiberglass) typically result in broomstick failures. The fibers constrained together by use of the pultrusion resin in the composite rod desire to buckle. The resin which binds the fibers together does not have the radial and transverse strength to keep the fibers bound together; therefore, the resin breaks apart, freeing the composite fibers from their containment. The fibers of the composite rod then no longer share the loading as intended; fibers break, the failure propagates nearly instantaneously, and the 'broomstick' failure results. It is literally not possible to retrieve the broken rod from within the production tubing during well maintenance; rather, the tubing string must be pulled from the well with the sucker rod system inside of it in order to eventually get to the failure point in the system, thus adding to more time and cost for maintenance of the system. These composite sucker rod failures also can be limited by way of keeping stress normal to the cross-section of the sucker rod and eliminating the flexing and buckling on the fiber rods, another application for the invention herein.

SUMMARY OF THE INVENTION

A stabilizer for a sucker rod has a continuous vane with helical profile which is attached along a length of the sucker rod body, between forged upsets for steel sucker rods or between end connections for composite sucker rods. The stabilizer extends from the sucker rod body to near the inner diameter surface of the production tubing. The helical profile continuously reinforces and stabilizes the sucker rod, constraining the central longitudinal axis of the sucker rods to be coaxial with the central axis of the production tubing. This helical profile affixed to the sucker rod centralizes and stabilizes the sucker rod in both tension and compression moments, preventing the buckling of the sucker rod due to the constant reinforcement of the sucker rod. The stabilizer is preferably corrosion resistant, strong and rigid, yet lightweight and affordable. The stabilizer is preferably formed of thermoset plastic but may also be formed of molded or extruded thermoplastics, aluminum, steel or brass.

The sucker rod stabilizer has a helical profile which is attached to the sucker rod, continuously reinforcing and stabilizing the rod throughout each coil section, increasing its area-moment of inertia ("AMOI") as an assembly. This forces the full length of the rod to stay within the central axis of the tubing during compressive loading. The ideal pitch of the profile is calculated by evaluating an extreme circumstance in beam-lifted wells, the maximum compressive loading possible (the weight of the rod string above the bottom-most sucker rod). The singular vane helically wrapping around the sucker rod allows for more efficient fluid flow patterns, reducing drag loads in comparison to standard sucker rod guides. The reduction in fluid drag through the helical efficient design allows for more efficient energy consumption for the pumping unit on the surface, as well as reduces the chance of solid and gas erosion and corrosion on the sucker rod body due to momentary pressure changes made by the surface of standard sucker rod guides which can lead to a swirling effect at the edges of the sucker rod centralizer, eroding the steel sucker rod body away over time. Additionally, the singular vane of the invention disclosed herein has a greatly reduced AMOI in comparison to traditional molded centralizers, allowing for geometric flexibility of the plastic profile which exceeds the flexibility of the sucker rod in all directions along the spine of the coil, and where the wrap around pad is on the helical profile, profile flexibility is approximately equivalent to the three-quarter inch sucker rod flexibility. Larger diameter steel sucker rods are far more rigid than the composite coil profile. Simulations and real-world testing has validated that the invention herein, molded from thermoset phenolic glass and mineral filled material features a stiffness matrix (flexural modulus of a polymer material to which it is comprised, multiplied by the AMOI of the profile) which is one-fourth (¼) that of sucker rod guides in industry. The polymeric profile is more flexible than other common rod guides, which allows for the rod, if it does buckle or flex, to not impose additional stress and bending moments along the rod body like that of traditional molded sucker rod guides. This is the core reasoning for the lack of bending moments and prolonged sucker rod fatigue life.

A manufacturing method of the present disclosure for producing coil centralizers includes the use of thermoset molding. Thermoset manufacturing creates dense, non-porous parts in comparison to thermoplastic molding which tends to create voids and holes in thick-walled molded sections. Thermoset manufacturing, through the use of phenolic molding compound, provides superior wear and friction benefits due to thermally stable high-modulus material (relatively speaking to its thermoplastic counterparts), and has been utilized in down-hole oil and gas applications for decades. Phenolic resins, mixed with a variety of fillers, are often used for tribological applications where friction, drag, or wear resistance is highly desired. Plastics industry experts commonly recommend thermosets, and typically phenolic reinforced molding compounds, for prolonged elevated temperature applications requiring unmatched wear resistance. The mold tools' core and cavity components, which are designed for the constant profile and helical pitch on the coiled stabilizers as presented herein, may be built in sections.

The present disclosure also addresses the centralizing need of the sucker rod within the tubing, and allows for, validates, and addresses the complication of the sucker rod buckling action during compression moments. Compressive stresses are not so problematic on the sucker rod so long as the rod does not buckle. The goal is to contain these compressive instances and keep the sucker rod stable so the ultimate compressive stress remains normal to the cross-section of the rod, drastically reducing the stress-amplitude, stress cycles and chaotic stress upon sucker rod loading. In review of FIG. 13, in one pumping cycle of the sucker rod, there are 5 instances of drastic peaks and valleys in stress behavior, tripling the cycle count that the rod body itself encounters in application. Eliminating the buckling behavior results in lengthening the fatigue life of sucker rods, in addition to general sucker rod-on-tubing wear protection.

By utilizing a helical profile, full length stabilizer along the small diameter sucker rod body, the sucker rod is constantly reinforced from end to end, staying in axial alignment with the production tubing. The helical profile can be made from any rigid, lightweight material, as one long unit affixed to the rod or in multiple sections to achieve the same desired effect. In production, it is advised to use a thermoplastic or thermoset polymer material, easily molded to shape and cost-effective. The difficulty in production of the helical coil is the pure length requirement to properly stabilize the sucker rod to the middle of the tubing. Sucker rods vary in length from nearly twenty-five to thirty feet. The sucker rod stabilization tool, to be effective, must reinforce the sucker rod so much as to increase its critical buckling load beyond the maximum potential compressive load in well. The maximum compressive load in application would be the weight of the sucker rods above the specific rod in question. The lowest sucker rod in the well has the most compressive loading potential, due to the full weight of the rod string above it. The rod just below the surface of the Earth, first in the well has the smallest compressive loading potential as only the mass of the surface polished rod is above it.

DESCRIPTION OF THE DRAWINGS

For a more complete understanding of the present invention and the advantages thereof, reference is now made to the following description taken in conjunction with the accompanying Drawings in which FIGS. 1 through 26 show various aspects for a stabilizer tool made according to the present disclosure, as set forth below:

FIG. 1 is a partial side elevation view of a sucker rod string disposed in a tubing string with the stabilizers extending between the sucker rod string and the tubing string;

FIG. 2 is a partial side elevation tool of a sucker rod with one of the stabilizers secured to the sucker rod;

FIG. 3 is a perspective view of one of the stabilizers;

FIG. 4 is a section view of the stabilizer tool, taken along section line 4-4 of FIG. 3;

FIG. 5 is a partial side elevation view of the sucker rod tool string, showing two sucker rods having a different number of stabilizers mounted thereto;

FIGS. 6-8 are perspective views of three configurations of molds for forming the stabilizers, over-molded directly onto respective sucker rods;

FIGS. 9-11 are respective side elevation views of the stabilizer tool molds of FIGS. 6-8;

FIGS. 12 and 13 show a comparison of the free length of the sucker rod between stabilizers made according to the present invention and prior art centralizers when spaced apparat along the length of a sucker rod;

FIG. 14 shows the effective distance at which the end of a stabilizer made according to the presentation invention will move with the sucker rod from being centered within production tubing;

FIG. 15 is a side elevation view of a sucker rod have a central portion which is centered within production tubing during buckling;

FIG. 16 is a graph of stress verses time for a sucker rod, depicting expected rod stress and actual stress occurring at conventional rod guides;

FIG. 17 is a graph of rod load, expected rod stress, tension node buckling and compression node buckling;

FIG. 18 is a graph of tensile modules vs. temperatures for several common sucker rod materials;

FIG. 19 is a chart listing values for boundary conditions for Euler's column formula for buckling for several sucker rod end constraint conditions;

FIGS. 20, 21A and 21B are flow charts depicting a manufacturing process for making stabilizers according to the present disclosure;

FIGS. 22 and 23 are fixtures for baking and curing stabilizers which formed of polymers which are over-molded onto such rods in the process;

FIGS. 24 and 25 are perspective views illustrating the high erodible wear volume of the stabilizer of the present disclosure, as compared to the erodible wear volume of conventional prior art centralizers; and FIG. 26 is a flow chart depicting a process for engineering stabilizers according to the present disclosure.

DETAILED DESCRIPTION OF THE INVENTION

Figure 1:
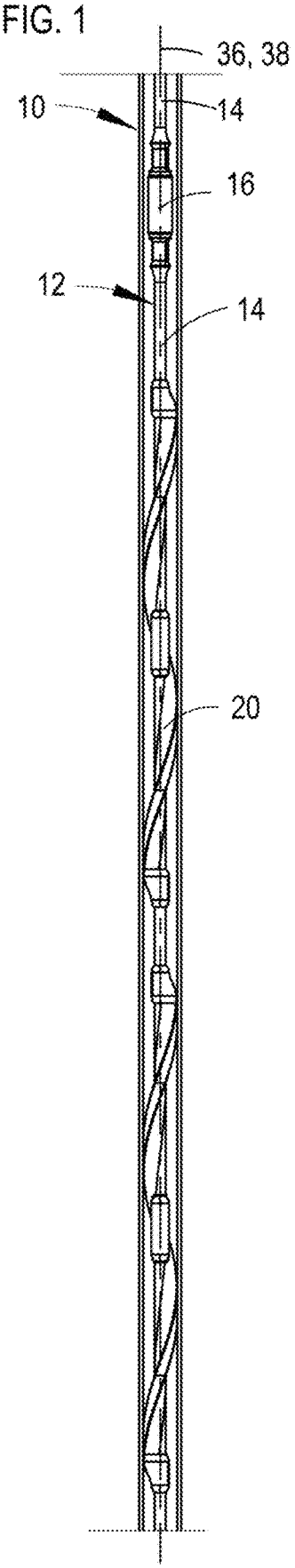

FIG. 1 is a partial side elevation view of a sucker rod string 12 disposed in a tubing string 10 with the stabilizers 20 extending between the sucker rod string 12 and the tubing string 10, centering the sucker rod string 12 within the tubing string 10. A sucker rod coupling 16 connects between two of the sucker rods 14. The stabilizers 20 each have a single vane 22 which helically extends around the sucker rods 14 and a thickness 18. The sucker rods 14 have a centrally disposed longitudinal axis 38 which is generally concentric with a longitudinal axis for the tubing string 10, with the stabilizers 20 centering the sucker rod string 12 within the tubing string 10. The stabilizer 20 and the stabilizer vane 33 have a longitudinal axis 36 which is concentric with the longitudinal axis 38 of the sucker rod 14.

Figure 2:
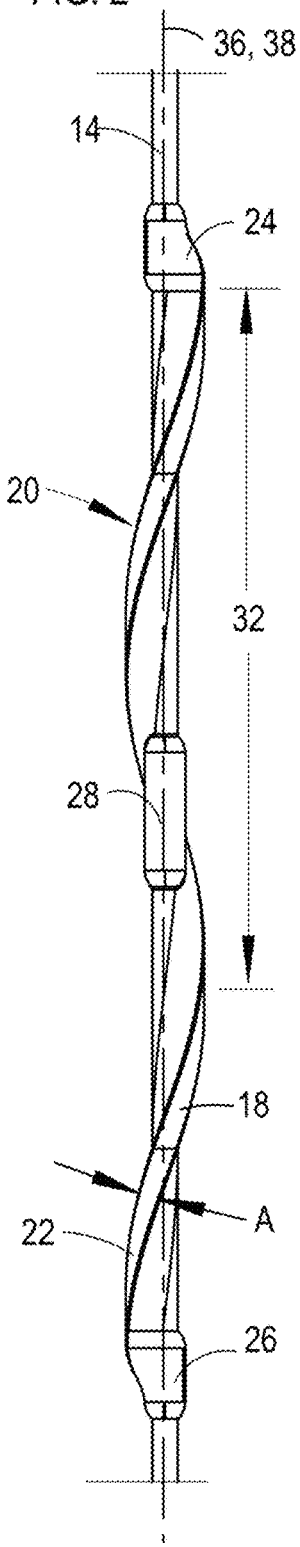
Figure 3:
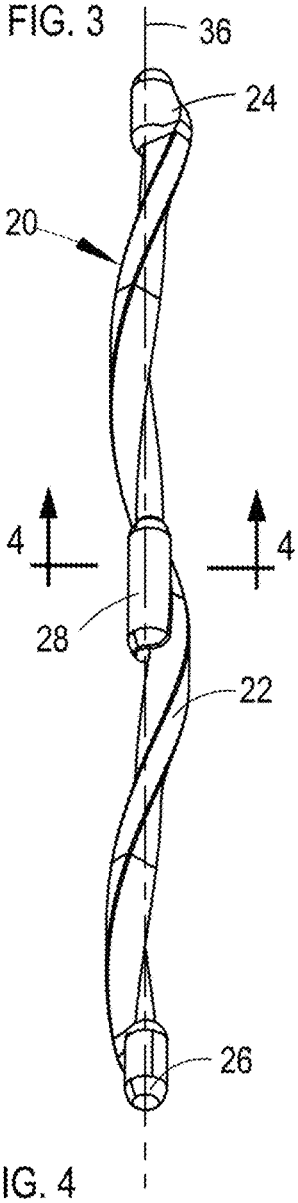

FIG. 2 is a partial side elevation view of a sucker rod 14 with one of the stabilizers 20 secured to the sucker rod 14 and FIG. 3 is a perspective view of the stabilizer 20 without showing the sucker rod 14. The stabilizer 20 is formed on the sucker rod 14 as a single unitary member which is over-molded onto the rod 14 and will generally not be independent from the sucker rod 14. The stabilizer 20 has the single vane 22 which helically extends around the sucker rod 14. The opposite ends of the stabilizer 20 are preferably formed into the shape of sleeves and provide molded collars 24 and 26 which provide wrap-around pads that extend fully around, enclose, and shrink-fit around the sucker rod 14. Similarly, the collar 28 is preferably formed in the shape of a sleeve located in a longitudinally intermediate portion of the stabilizer 20, and provides a wrap-around pad which extends fully around and encloses the sucker rod 14. The vane 22 extends around a length of the sucker rod 14, gripping the exterior of the sucker rod 14 to secure the stabilizer 20 to the sucker rod 14, providing full isolation from the tubing string. The collars 24, 26 and 28 provide a further grip of the stabilizer 20 to the exterior of the sucker rod 14. The vane 22 has a pitch 32 helically extending around the sucker rod 14. The pitch is the distance at which the vane 22 extends in the direction of the longitudinal axis 36 and returns to the same angular position relative to the sucker rod 14, computed by analysis of extreme reciprocating rod lift rod string application and use.

Figure 4:
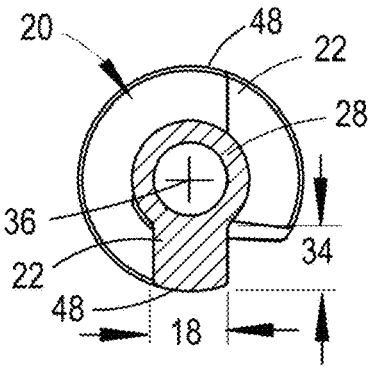

FIG. 4 is a section view of the stabilizer 20, taken along section line 4-4 of FIG. 3 which is perpendicular to the longitudinal axis 36. The vane 22 is shown to preferably have a substantially rectangular cross-sectional area with arcuately shaped radially outward and radially inward ends. The vane 22 is shown extending around the longitudinal axis 36. The collar 28 is shown fully enclosing an internal space in which a section of the sucker rod 14 will be located. The vane 22 along the section line 4-4 has a radial length 34 which is extends perpendicular to the longitudinal axis 36 and a thickness 18 which extends perpendicular to the radial length 34. The terminal end of the vane 4 has an outer surface 48.

Figure 5:
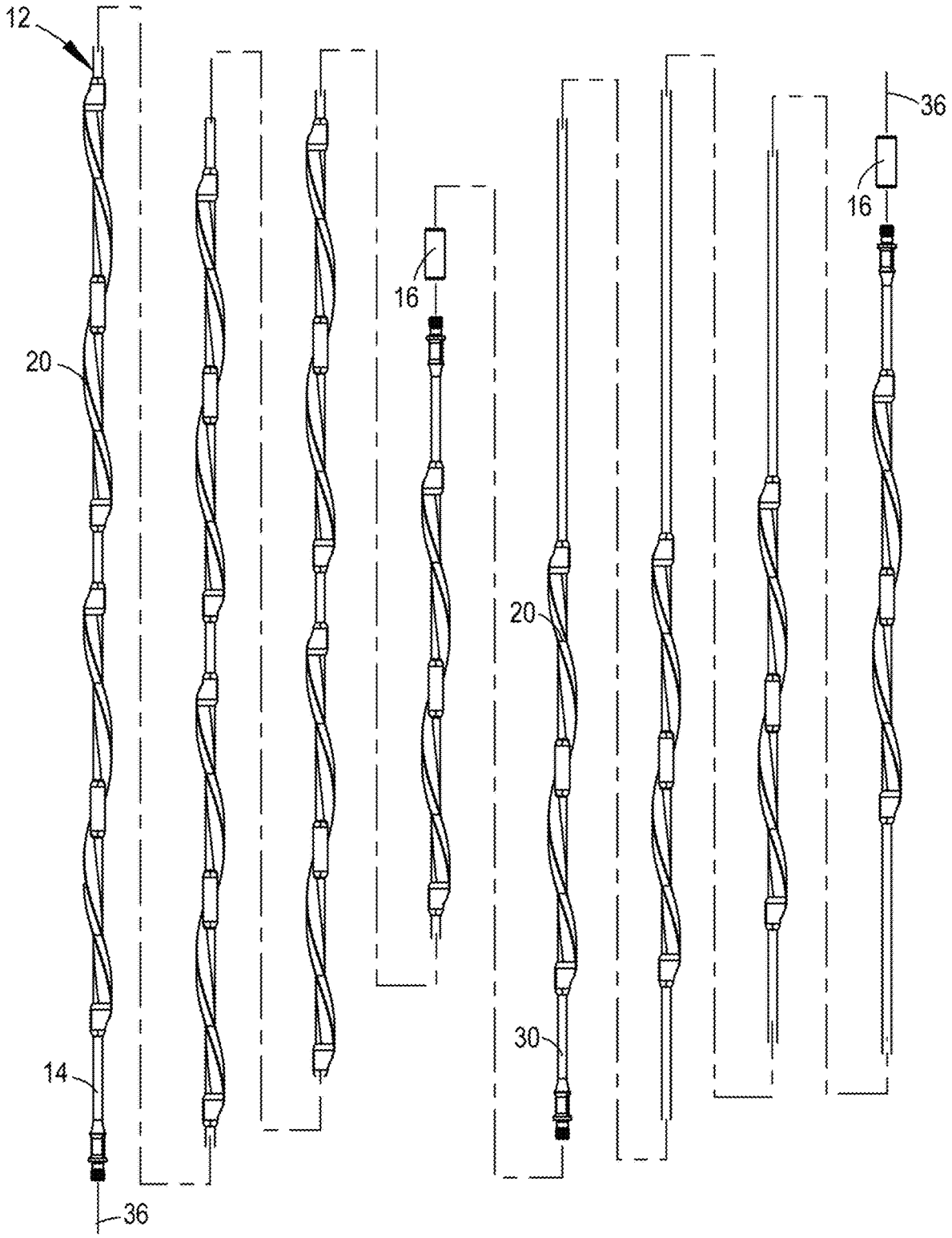

FIG. 5 is a partial side elevation view of the sucker rod string 12, showing the sucker rod 14 and a sucker rod 30 having a different number of stabilizers 20 mounted thereto. Seven of the stabilizers 20 are secured to the sucker rod 14 and four of the stabilizers 20 are secured to the sucker rod 30. Preferably, a greater number of the stabilizers 20 are secured to each of the sucker rods 14 which are located further downhole where more loading from the weight of the sucker rods string is located and buckling tendency is much higher. For sucker rods 14 located further up-hole a lower number of the stabilizers 20 per sucker rod 14 may be used where loading from the sucker rod string 12 is less and buckling tendency is lower. Further up-hole from the sucker rod 30 a smaller number of stabilizers may be used, going from four of the stabilizers 20, to three of the stabilizers 20, to two of the stabilizers 20, and then one of the stabilizers 20 per sucker rod 30. Below is a discussion regarding calculating the number of the stabilizers 20 required per sucker rods 30 to prevent buckling and damage from bending moments caused by the weight of the sucker rod string 12 applied cyclically during pumping.

Figure 6:
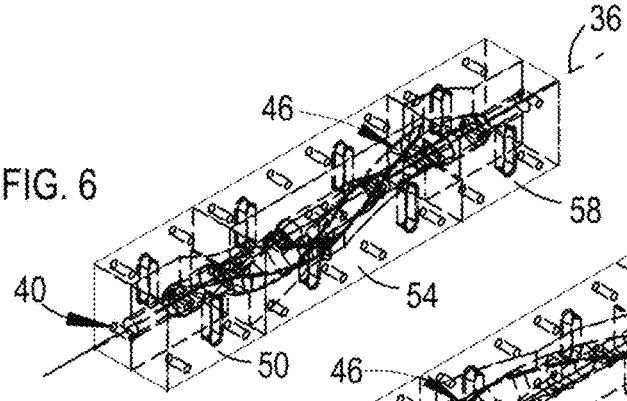
Figure 7:
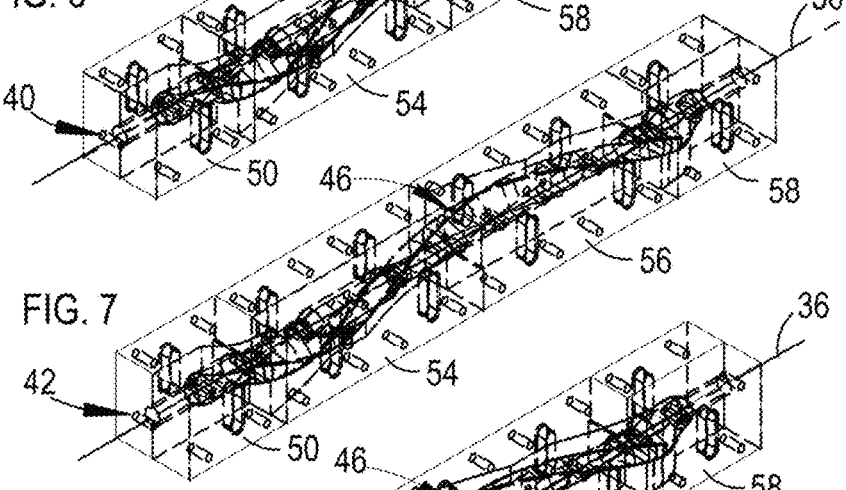
Figure 8:
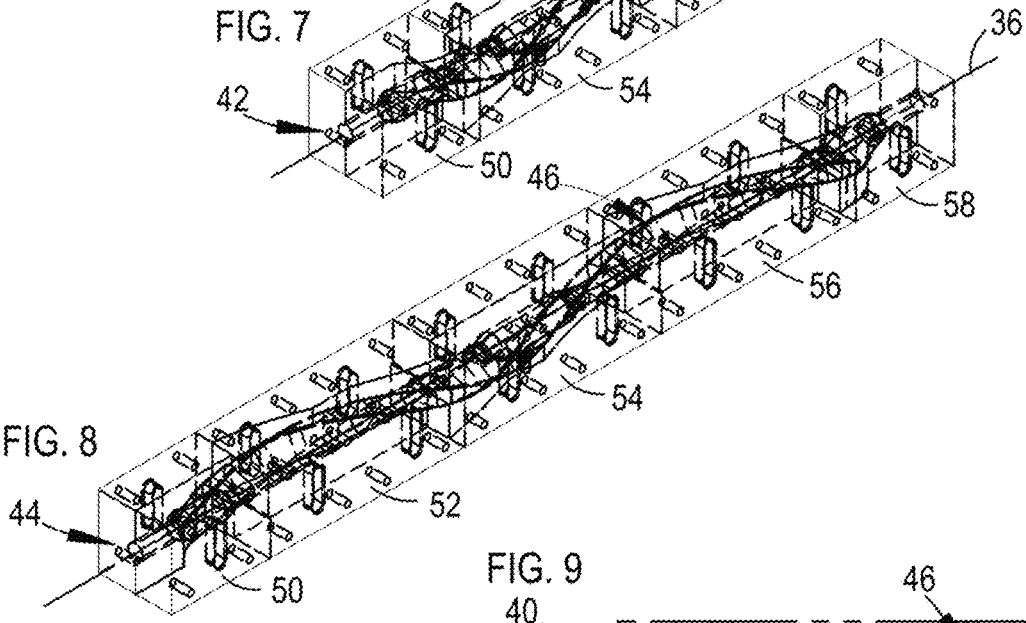
Figure 9:
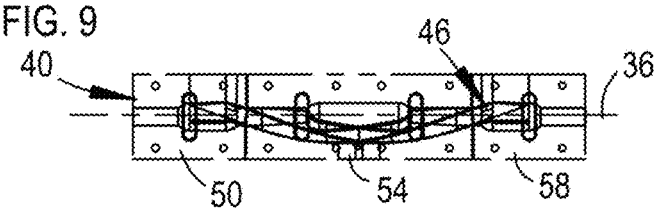
Figure 10:
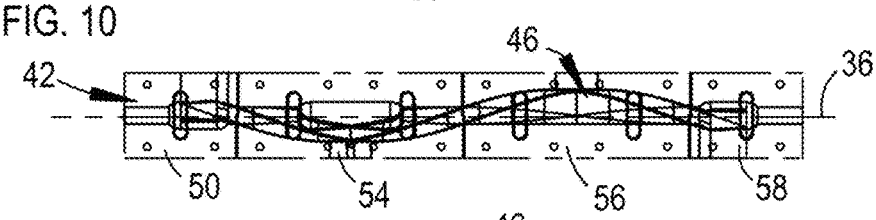
Figure 11:
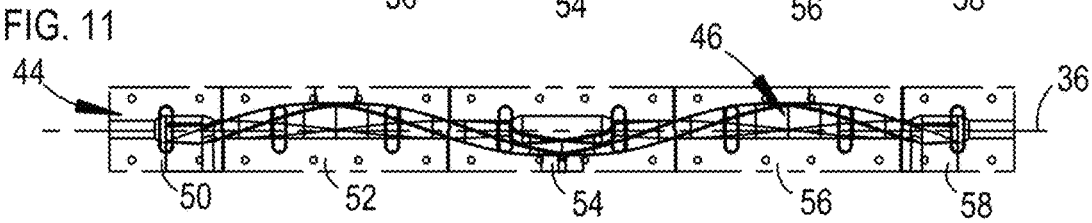

FIGS. 6-8 are perspective views of three configurations of molds for forming the stabilizers, over molded directly onto respective sucker rods, and FIG. 9-11 are respective side elevation views of the stabilizer tool molds of FIGS. 6-8. In addition to placing a smaller number of stabilizers 20 per sucker rods 14 in tool string positions located further up-hole, the lengths of the stabilizers 20 may be reduced by over-molding stabilizers 20 of smaller lengths. The mold configurations 40-44 shown in FIGS. 6-11 each provide stabilizers 20 of the same pitch, but with different lengths. The mold cavity 46 is shown as extending through each of the mold sections 50-58, with a form which is generally concentrically disposed with the axis 36 for the sucker rod 14 and the stabilizer 20. FIGS. 8 and 11 show a mold configuration 44 using each of the mold sections 50-58 for the stabilizer 20 having the longest length. FIGS. 7 and 10 show a mold configuration 42 which is of an intermediate length, shorter than the longer mold length of the mold configuration 44 of FIGS. 8 and 11, and which is provided by removing the mold sections 52. FIGS. 6 and 9 show a mold configuration 42 which is of a shorter length, than the intermediate mold length of FIGS. 7 and 10, and shorter than the longer mold length of the mold configuration 44 of FIGS. 8 and 11, and is provided by removing the mold sections 56 from the mold configuration 42 shown in FIGS. 7 and 10. Thus, the same mold sections 50-58 may be used to provide stabilizers 20 of three different lengths, but having the same helical pitch 32. Preferably, the mold sections 50-58 are each formed of two halves which are fitted around a sucker rod and joined, or secured, together, and then the mold sections 50-58 are secured to the sucker rod in sequential alignment for the inclusion of the end-located molded collars 24 and 26.

The helical coil mold cavity 46 shall be various combinations of the mold sections 50-58, making up the full helical profile to be molded, perhaps approximately forty inches in length. By removing the section 52, and co-joining modular tooling section 50, 54, 56, and 58, as shown in FIGS. 7 and 10, the molded profile can be shortened for less material usage and less cost to the customer, perhaps approximately thirty inches long. The constant design of the helical pattern allows for this modularity due to consistent molded section.

Further, by removal of an additional mold section 56, and co-joining sections 50, 54 and 58, a reduced coil length can be produced further allowing for cost-savings in material and cost-savings to the end-user, without the need or requirement of additional tooling expense. In the present embodiment, the helical profile has tapered edges on the start and end of the coil for smooth fluid flow. The mold sections 50 and 58 containing the end profile taper and molded collars 24 and 26 are desirable in use for any molded profile.

Figure 12:
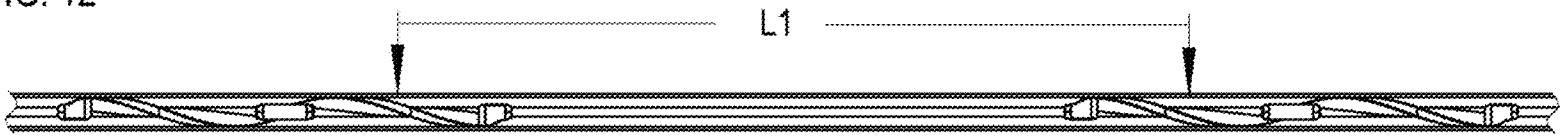
Figure 13:
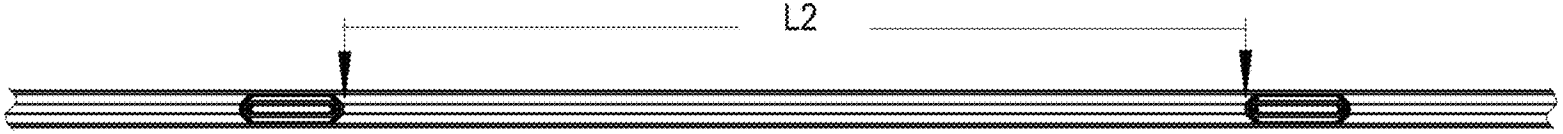

FIGS. 12 and 13 show a comparison of the free length of the sucker rod between stabilizers made according to the present invention and prior art centralizers when spaced apart along the length of a sucker rod. For the same number of centralizers disposed on sucker rods of approximately the same length, the free distance of the sucker rod between a stabilizer of the present disclosure is L1. A similar length between two conventional centralizers shown in FIG. 13 is L2, which is longer than L1 of FIG. 12. Additionally the bypass area for fluid flow around a stabilizer of the present invention is larger than that of a conventional centralizer.

Figure 14:
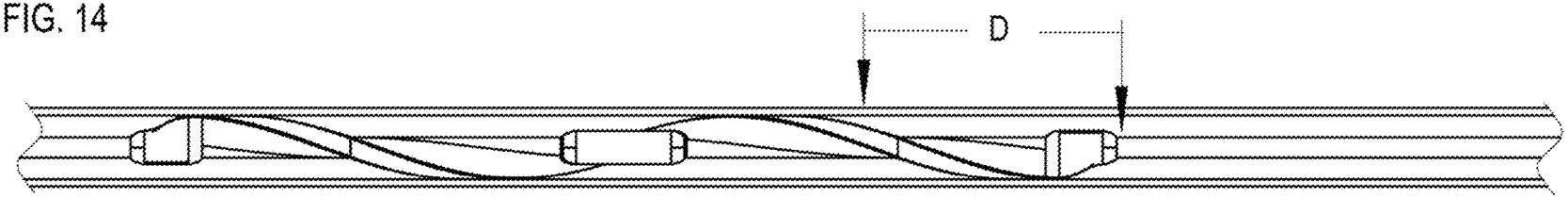
Figure 15:
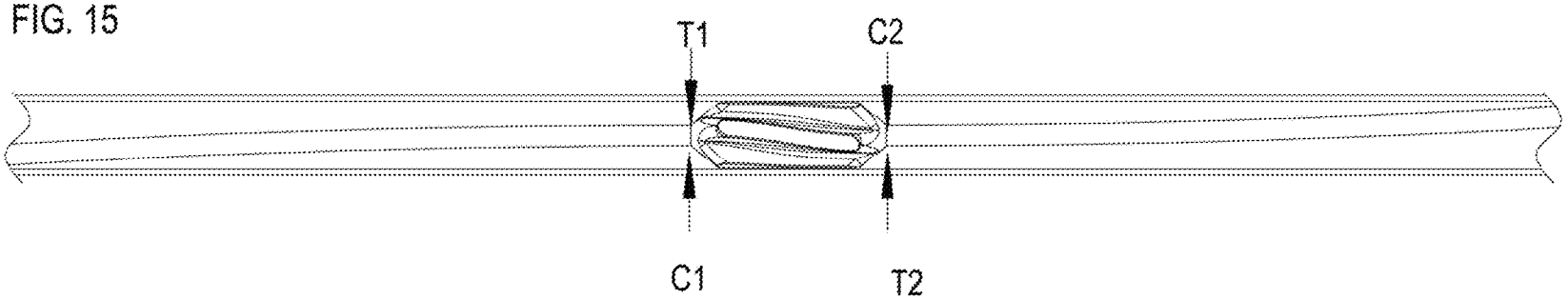
Figure 16:
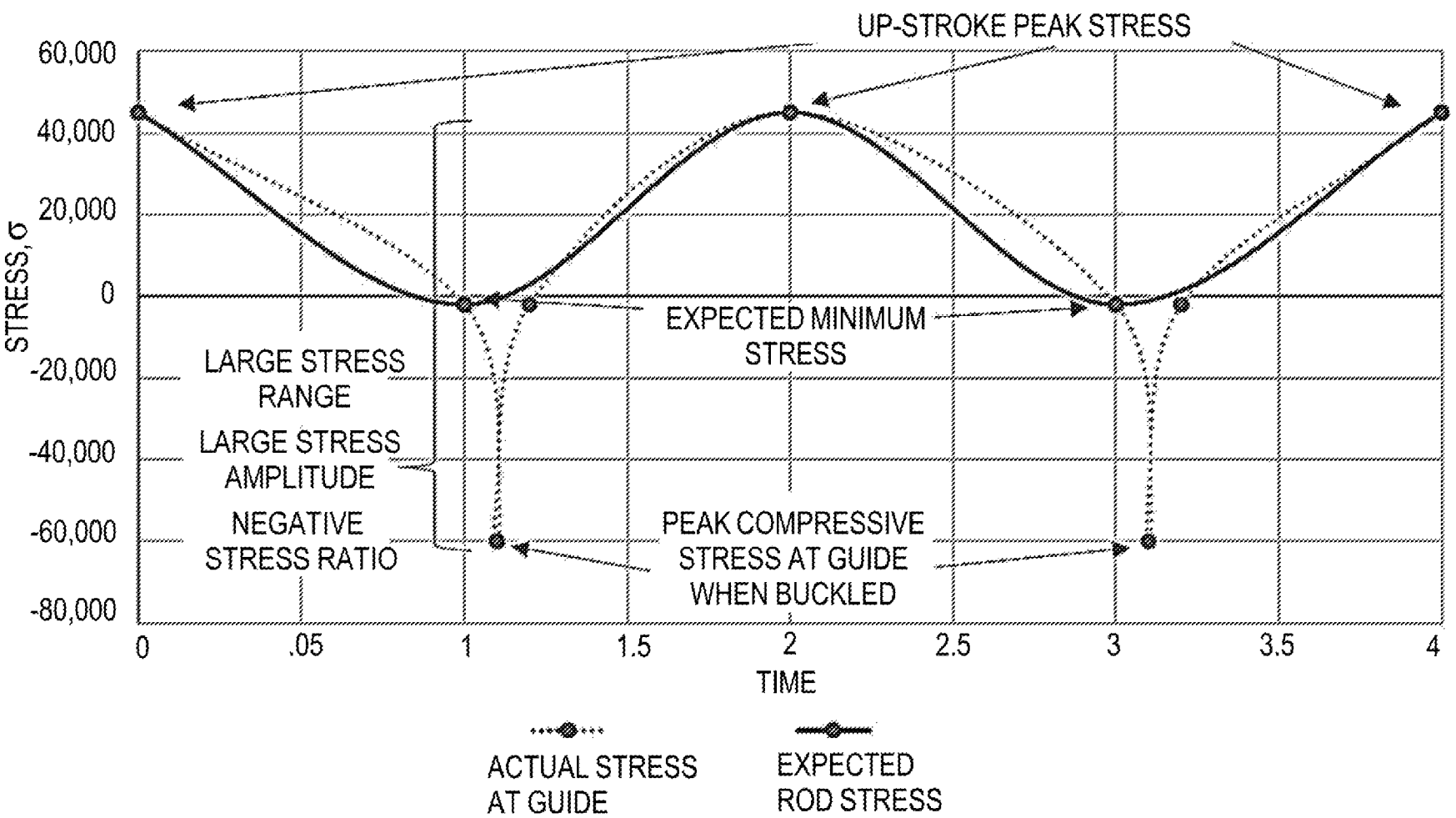
Figure 17:
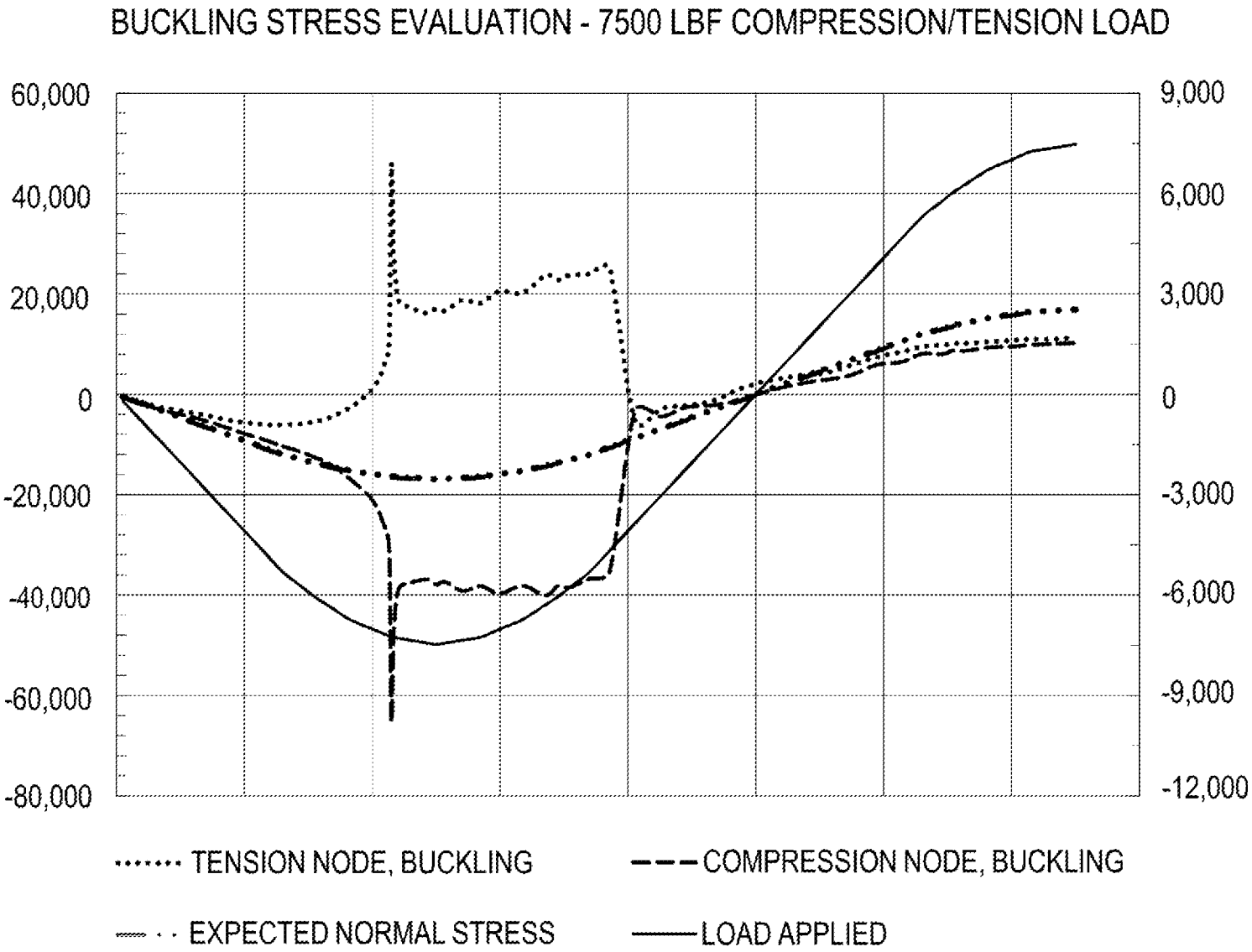

FIG. 14 shows the effective distance at which the end of a stabilizer made according to the presentation invention will move with the sucker rod from being centered within production tubing. This transition region extends for a distance D from the end of the stabilizer to a point along the stabilizer at which the rod is maintained in a substantially coaxial alignment with the production tubing. The transition region in the single helical blade stabilizer in combination with the sucker rod which extends a distance D provides significant compliance, or spring-like flexibility, in centering the sucker rod as compared to conational stabilizers. That is, in the transition region D both the stabilizer and the sucker rod may flex to reduce stress from being concentrated in the sucker rod at the end of the stabilizer.

The transition for bending of the rod at the ends is enabled by the wrap around sleeves providing a coupling which grips the rod with a shrink fit. Without a secure grip between the rod and the spiral-shaped, single fin stabilizer, the bending transition D would not be provided since there would be significant slip between the stabilizer and the rod. The spiral shaped fin also grip the rod along with the wrap around sleeves, but shrink fitting a fulling enclosing wrap around sleeve provides a non-slip grip as compared to shrink fitting the spiral shaped fin to firmly affix the stabilizer to the rod Steel sucker rod weights range from about 35 lbs. to nearly 85 lbs., dependent on diameter. The weight of each rod can then increase depending if it has other accessories attached to the rod. A deep rod pumped well may approach 10,000 feet of sucker rod or more and will feature a tapered sucker rod string, the assembly of multiple sucker rods attached together through couplings end-to-end. A tapered rod string could be similar to that which the first 2,000 feet below the surface is 1-inch diameter sucker rods, a very common large rod in use for wells. The next 3.000 feet of the rod string (well depth of 2,000 feet to 5,000 feet) may changeover to ⅞-inch diameter sucker rods, and the remaining 5,000 feet (well depth of 5,000 to 10,000 feet) to ¾-inch sucker rod. Twenty-five feet of length for each sucker rod, most common in the United States, would for this example create a cumulative weight of the rod string nearing 20,000 pounds without any rod string accessories. Buoyant weight of this rod string, in oil/water mixture, will reduce the effective weight of the rod string based on fluid density and volume of product in the well. However, upon initial install of the sucker rods and utilizing the compressive force to seat the pump in the seating nipple, the rod string is not necessarily submerged in fluid therefore its full weight could be imposed on the down-hole pump for seating. Ironically, ¾-inch sucker rods at the bottom of the well are more prone to compressive loading due to the accumulation of weight above them, and therefore the ¾-inch sucker rods tend to fail much faster. Deep well ¾-inch rod parts are very, very common in industry.

Engineering math to calculate the necessary sucker rod reinforcement to best prevent buckling along the sucker rod is shown below:

E=modulus of elasticity (psi)=29,700,000

$$I = \text{moment of inertia (in}^4) = \frac{\pi D^4}{64}$$

L=length of reinforcement, helical pitch (inches)
F=load (lbs)
n=boundary condition
Euler's Column Formula:

$$F = \frac{n\pi^2 EI}{L^2}$$

Figure 18:
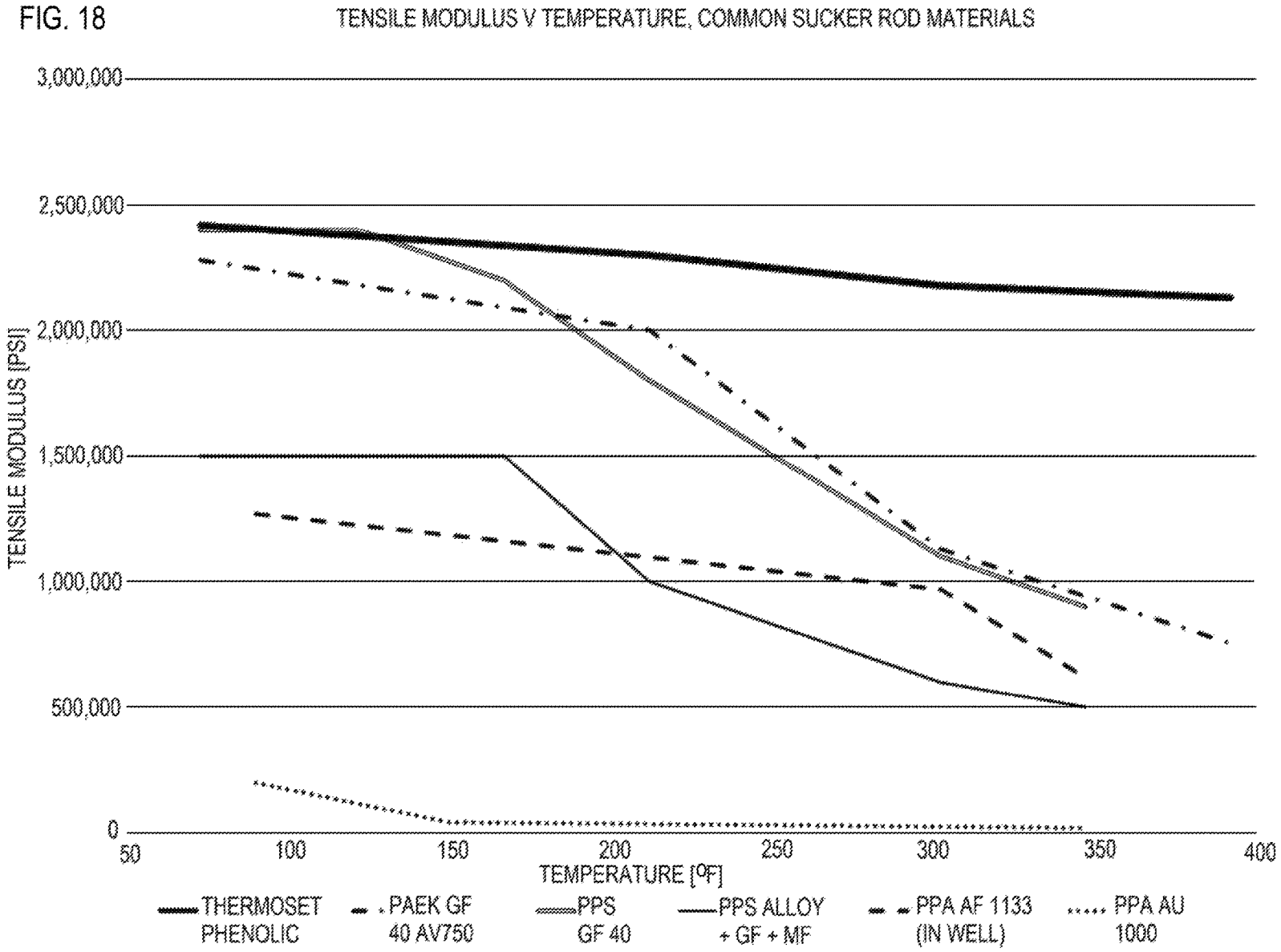
Figure 19:
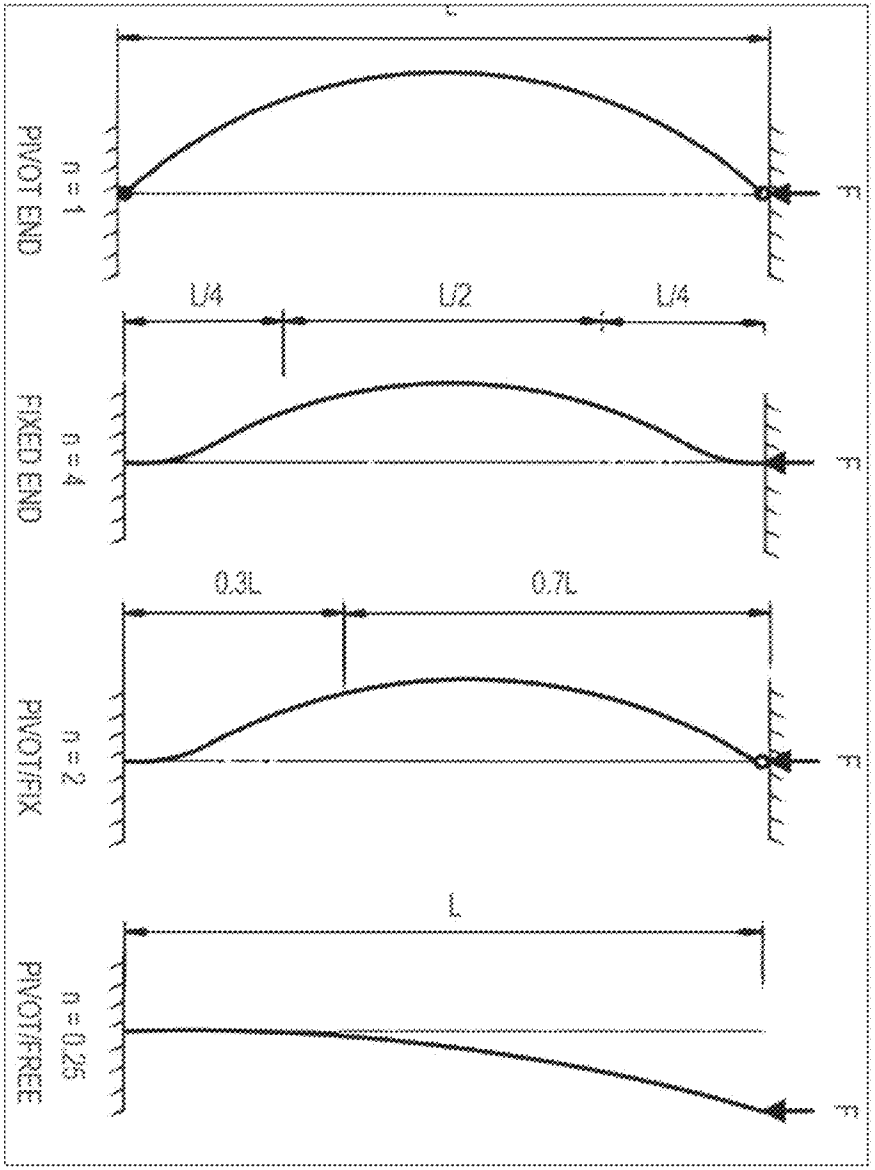

FIG. 18 is a graph of tensile modules vs. temperatures for several common sucker rod materials, and FIG. 19 is a chart listing values for boundary conditions for Euler's column formula for buckling for several sucker rod end constraint conditions. The boundary condition can vary from 1 to 4, depending on the fixture reinforcement type for the sucker rod:pivot, fixed, or a combination of the two. Sucker rods are constrained to the inner diameter of production tubing and therefore behave somewhere between fixed and pivot connections.

The weight of the rods and peak compressive loading is known based on specific rod-string design for the particular well. The formula shall be rearranged to solve for Length, providing for the optimal length of moments of stabilization and reinforcement. For the product design enclosed, the helical pattern shall have a pitch no less than what is required of the well and loading.

Rearranged the formula and solving for Helical Pitch provides the following:

$$\text{Helical Pitch} = \sqrt{\frac{n\pi^2 EI}{F}}$$

Peak compressive loads at various boundary conditions are shown in TABLE A:

TABLE A

| Rod Diameter (inches) | Depth (feet) | Calculated Compressive Load Potential (lbs.) | Helical Pitch (inches) |
|---|---|---|---|
| ¾" | 10,000 feet | ~20,000 lbs. | n = 1: 15.1", n = 2: 21.3", n = 4: 30.2" |
| ⅞" | 5,000 feet | ~12,000 lbs. | n = 1: 26.5", n = 2: 37.5", n = 4: 53.0" |
| 1" | 2,000 feet | ~5,500 lbs. | n = 1: 51.0", n = 2: 72.2", n = 4: 102" |

Looking at the table above, the smallest diameter rod with a pivot end (n=1), would require approximately a 15-inch helical pitch. Sucker rod behavior in well and co-joined with traditional sucker rods is more reflective of an n=2 scenario, where there is a fair amount of rigidity at the coupling due to the increased diameter of the steel coupling profile. This is the most conservative pitch spacing and could be considered for the above to provide maximum rod stabilization; however, sucker rods are conjoined and often reflect a scenario much closer to that of Fixed End condition (n=4). In observance of the above data, it is obvious that as load decreases and rod diameter increases, the sucker rod becomes more stable, and less likely to buckle. A 1-inch diameter sucker rod with 2,000 feet of rod above it, has about 5,500 pounds of compressive load potential and requires reinforcement between 51 inches and 102 inches based on the end-condition in which it is constrained. In a well with a full fluid column, the compressive load potential reduces greatly due to buoyancy.

In addition to the helical pitch consideration for maximum effect on stabilization of the sucker rod, a material selection for the helical profile shall be evaluated. In mass manufacturing, plastics dominate. Injection molding of thermoplastics for down-hole use have been around since the mid-20$^{th}$ century, particularly for the thermoplastic sucker rod guides which can be over-molded directly on the sucker rod. FIG. 14 is a graph showing tensile modulus verses temperatures for several common sucker rod materials.

Recent advancements made by Martin shown in U.S. Pat. No. 9,869,135, issued Jan. 16, 2018, provide for thermosets to be efficiently manufactured directly around sucker rods for sucker rod guide use. However, U.S. Pat. No. 9,869,135 does not address the buckling nature of sucker rods and instead it is directed toward the periodic implementation of multi-vane centralizers around sucker rods, similar to that of which has been done for nearly 60 years and is limited in scope due to the prior art. If sucker rod pumping was in an ideal world and perfect state, current market offerings of multi-vane centralizers periodically molded around the sucker rod, typically 4 to 8 guides per rod, would be a desirable and effective solution. In fact, traditional sucker rod guides are effective regardless of which material rod guides are comprised of. High modulus and high compressive strength materials at the application temperature dictate the performance of the product. Because thermosets do not soften when heated like thermoplastics, thermoset performance is predictably better than thermoplastics for the application and use in elevated temperature, down-hole environments.

In molding and manufacturing of sucker rod guides, the molded plastic profile is formed directly around the sucker rod. As the molding material is cooling, whether thermoset or thermoplastic, it shrinks around the sucker rod, hugging and bonding to it tightly, creating a tight friction bond between the sucker rod surface and centralizer, inducing hoop stress at the inside diameter of the molded profile. A similar manufacturing method can take place with the helical profile. The material shrinkage, a component and property of plastic compounds, takes place in the longitudinal and transverse direction relative to the flow of material when molding. Further, this shrinkage takes place in accordance with the centroid of the molded part. Wrap-around pads for the helical profile, for complete sucker rod encapsulation can be added periodically for further shrinkage and bonding to the sucker rod. Further, the surface roughness of the sucker rod can be modified or improved while maintaining compliance to sucker rod manufacturing requirements, leading to more texture for the plastic molded profile to fill in and intimately connect to.

Molding plastic components around foreign objects is referred to as "insert molding" and is common practice. All engineering plastic suppliers recommend the heating of the insert to match the recommended mold temperature in order to maintain ideal plastic properties. The force to displace a sucker rod guide axially, which is molded around a steel sucker rod, varies based on centralizer/guide selection, testing temperature, steel rod surface finish, and molding pressures; the displacement value varies from 1,500 lbs.-force to 25,000 lbs.-force, strictly created from shrink fit, rod texture and friction bonding.

Specifically discussed relating to the manufacturing of thermoset phenolic resins, mold temperature and insert temperature (the sucker rod) must be strictly monitored and controlled. The chemical reaction curing process of thermoset resins is sensitive with regard to time, temperatures, and pressures. Too cool of insert (sucker rod) or too cool of mold temperature will create parts which have not undergone a complete chemical reaction. Any un-cured resin components in the molded profile, when subject to down-hole fluids, will wash out and leave voids in the profile, most typically observed against the sucker rod body, leading to centralizers which slip, slide and move along the sucker rod body axially. This is a result of poor manufacturing and quality control. Ideal insert molding requires the insert to match the resin supplier and advised temperature of the mold tool, both in thermoplastic and thermoset molding. In this case for phenolic resins, the insert temperature would approximately be between 325 degrees F. and 375 degrees F. In the case of thermoplastic molding, the insert temperature will most likely be between 200 degrees F. and 300 degrees F., respective of the resin manufacturer's guidelines. The surface of the sucker rod steel in injection molding is exposed to temperatures in excess of 500-700 degrees F., caused by material melt temperatures. This is very important in studying and understanding consistent non-linear plastic material properties of the finished molded profile. Without proper curing of thermoset materials, the molded plastic parts around the insert may slip, slide, or break apart due to a lack of molecular bonding and crosslinking, which does not allow for the molded part to feature its extreme hydrocarbon resistance. Following the manufacturer guidebook is imperative to create parts which match that of the lab-molded test parts, representing physical and mechanical properties in the material datasheets. Failure to do so will result in subpar parts which do not meet the application and industry requirements for down-hole centralizer or stabilizer tool use.

Figure 20:
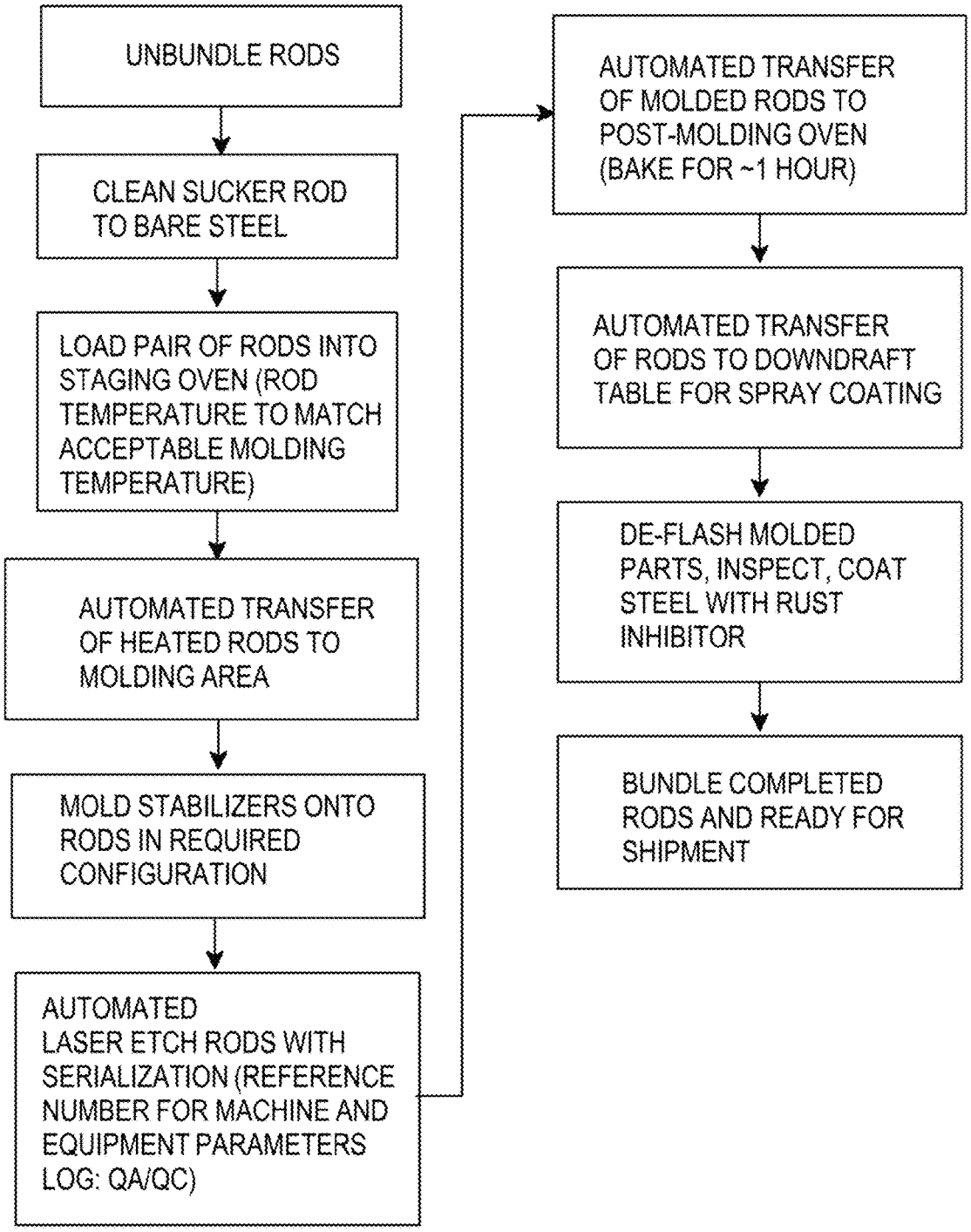
Figure 21A:
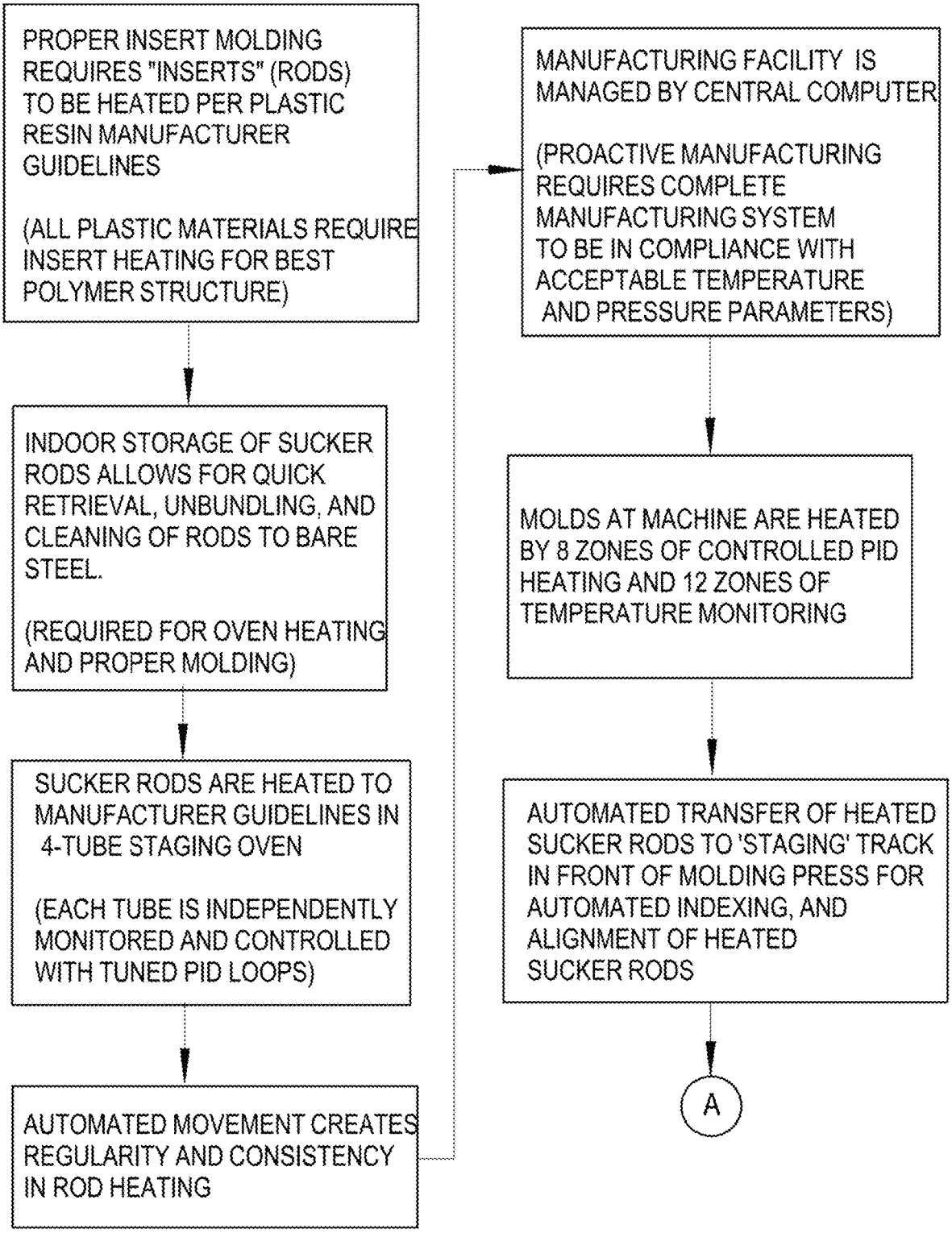
Figure 21B:
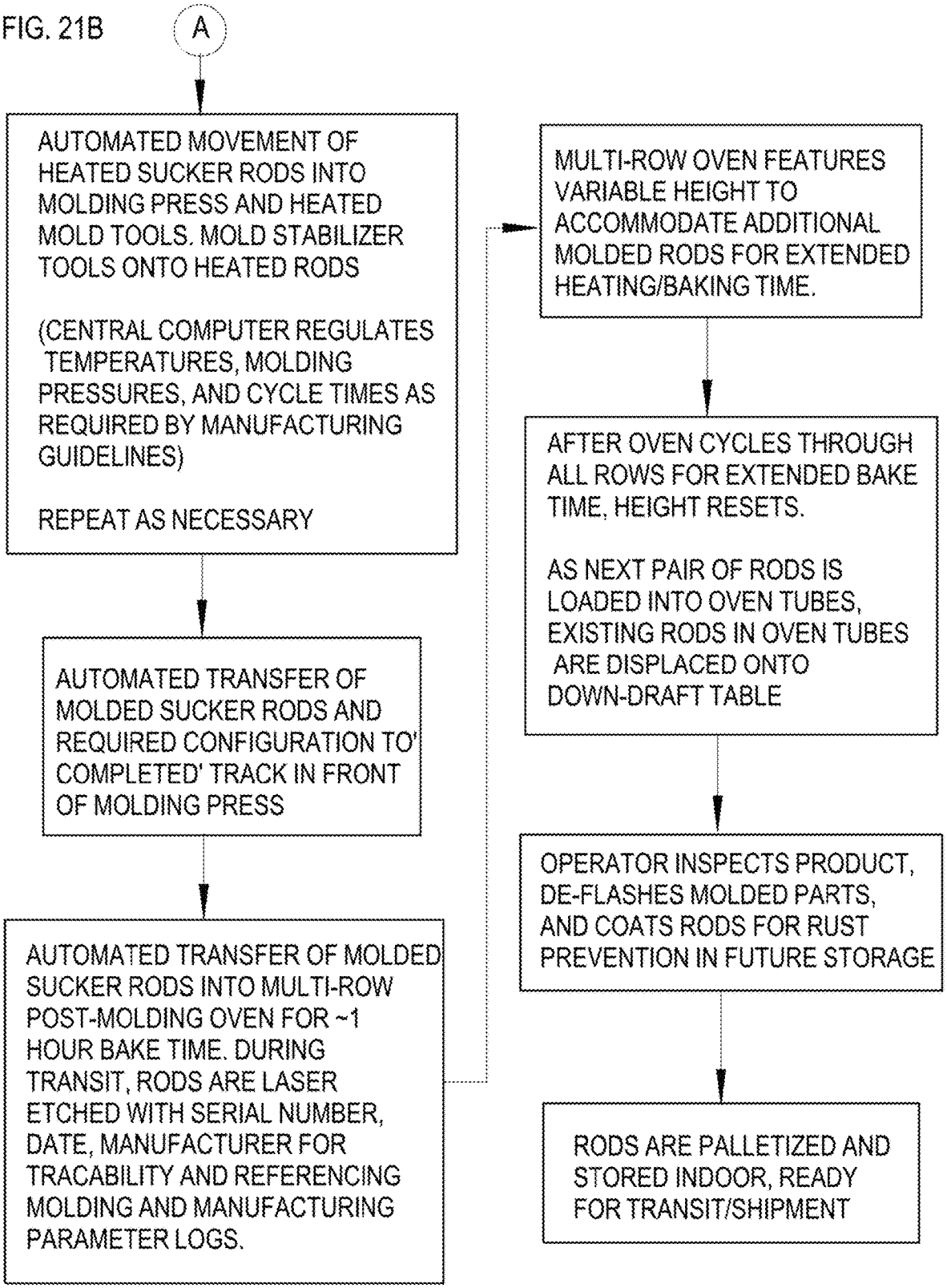

FIGS. 20, 21A and 21B are flow charts depicting a manufacturing process for making stabilizers according to the present disclosure. In the primary manufacturing process and due to the extended length of the sucker rod stabilization tools, a sucker rod must be cleaned from its corrosion inhibitor coating down to bare steel. Common industry practice for a number of decades includes use of wire wheel brush systems which remove the coating and expose bare steel for maximum consistency in molding. Additionally, new and novel for the manufacturing of the sucker rod stabilization tools described herein, is the addition to the manufacturing process of full-length direct conduction heating of the sucker rod body prior to molding, with adjustable PID closed-loop temperature control system. This ensures the heating of the inserts is at an acceptable range complimentary to the molding process for the thermoplastic or thermoset resins, heavily advised by the material suppliers of all plastic resins and compounds. The conduction heating system features aluminum tubing open on each side, with heating elements secured to the outside of the diameter of the tubing. The tubing is then directly heated and monitored with thermocouples. The sucker rods slide in one end and direct heat conduction from the aluminum tube heats the steel sucker rod body. The sucker rod body is heated for a given amount of time complimentary to the molding and manufacturing cycle of the sucker rod stabilizers. The sucker rod and the molded sucker rod stabilizer are then ejected through robotic automation from the other end of the aluminum tube from which the sucker rod was initially inserted. The aluminum tube is aligned with the automation cells in and around the custom-tailored hydraulic molding presses for passing the sucker rods and molded sucker rod stabilizers directly into one of the cells. Temperature controls are integrated with the parent industrial control system which is monitoring and regulating both the press mold temperatures and the oven temperatures. Any thermal parameters out of allowance shut down the parent system, creating a proactive manufacturing cell rather than typical human-intervened reactive manufacturing. This ensures the plastic, as it flows from the injection location through the mold cavity, does not see, recognize or behave any differently along the sucker rod insert than it would along the mold cavity surface. In order to flow thermoset phenolic resin along the long helical profile, the mold temperature and insert temperature must be kept steady and complimentary to one another, low enough to allow resin flow through the cavity without chemical crosslinking and solidification prior to the filling and packing of resin within the mold tool and around the insert, yet high enough to encourage flow and achieve an acceptable cycle time for the curing of the phenolic resin. This delicate balance is specific to the stabilization tool manufacturing process and requires hyper-accurate resin temperature and speed control throughout the flowing and filling of mold cavities.

Furthermore, upon the ejection of the molded parts, the sucker rods with the molded stabilization tools then are loaded into a multi-row and multi-column oven with similar aluminum tubes and heating elements to the foregoing. This oven is affixed to a hydraulically actuated lift table assembly which allows for vertical movement, keeping the molded goods in a heated environment as a post-bake, quality control process to ensure no plastic molded parts leave the manufacturing facility without an ideal cure profile having been completed. Each row can be in axial alignment with the tracks in front of the hydraulic molding presses by way of height-regulated automation. Automated systems, after the molding of the stabilization tools, load the molded profiles and sucker rods into the post-molding curing tubes. The tubes then move vertically after every molding cycle. Each tube is independently controlled with PID closed-loop temperature control system, allowing for tube specific temperature profiles to be regulated complimentary to the mold temperatures in the hydraulic press molding cell. As the scissor table raises or lowers, the tubes allow for the cycling of new molded components in each row. Once each row is occupied, the scissor table resets, the automation then loads the next freshly molded rods into the tubes which are occupied, displacing those molded sucker rods which have been in the oven for an extended period of time onto the de-flashing and rod-coating area. The system then continues and repeats. The system is arranged so that all molded components are subject to curing temperature or post-bake temperature 6 times longer than necessary to cure the molded profile. Industry recommended practice for a quality molded part is approximately one minute of curing time per ⅛" of thermoset phenolic cross-section. In the case of traditional, large cross-section sucker rod guides, this would be approximately a six-minute curing cycle assuming the sucker rod inserts are heated to the same temperature as the mold tools. In the event of a cooler rod temperature, the curing time would need to increase. It is possible to mold parts faster than this timeline as the chemical reaction based molded is exothermic and the steel rods will hold and act as a heat source to encourage phenolic curing; however, its consistency and the molecular integrity of the molded part may suffer, and the molded profiles' material properties would not represent the material datasheet accurately. This would lead to an accelerated wear rate in application, or a reduction in frictional bonding to the sucker rod insert, again leading to slipped centralizers which may break or de-bond from the sucker rod body.

Figure 22:
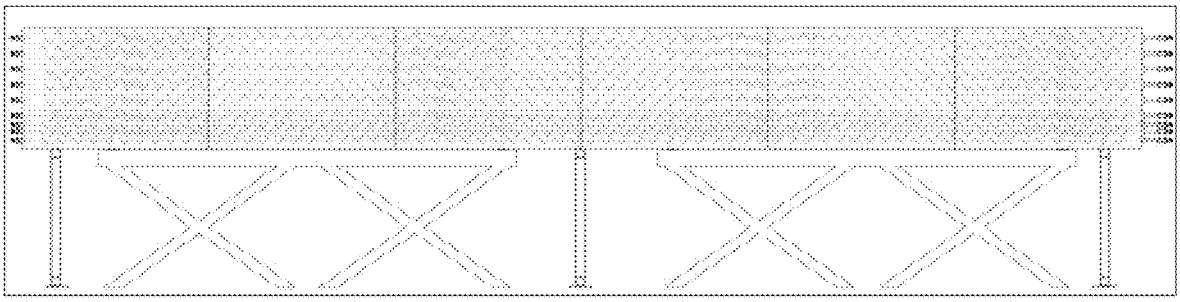
Figure 23:
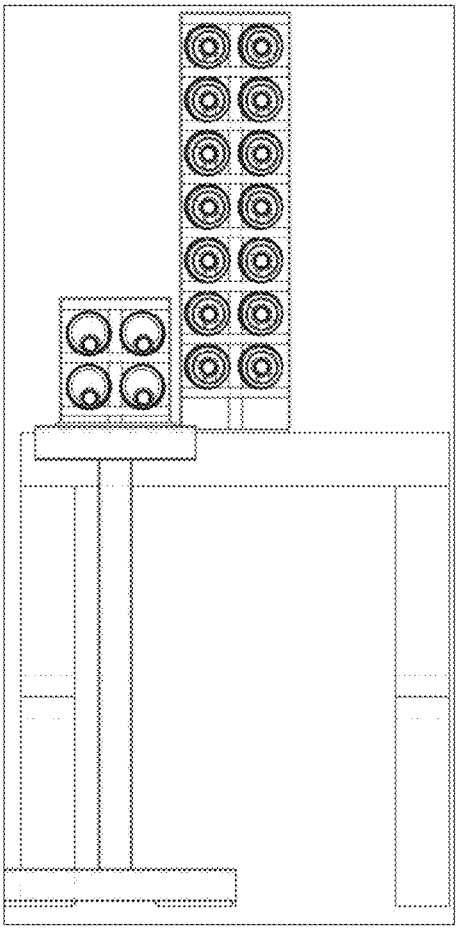

FIGS. 22 and 23 are fixtures for baking and curing stabilizers formed of polymer materials which are over-molded onto sucker rods in a batch process. The automation system for the handling of sucker rods both from the feed-oven, in and out of the molding presses, and into the post-molding baking oven is handled via precision ball-screw and belt-drive linear slide assemblies, powered by servo-controlled motors. Servo motors with specialized encoders are used with constant position feedback, and the repeatability is as accurate as $1/6400^{th}$ of a revolution. This allows for positional accuracy through the manufacturing process nearly less than $1/10{,}000^{th}$ of an inch (0.0001"). Furthermore, the automated loading and unloading of sucker rods into the mold tools helps regulate typical human error or abusive handling, as the automation is programmed with force, velocity and torque control to allow for precise and gentle handling of the sucker rod in and out of the production cell. This handling system, along with the pre- and post-bake oven system, is entirely new, unique, and novel to the manufacturing of sucker rod centralization or protection devices. With modem control closed-loop feedback and integration of one process to another throughout the facility, reduced overhead, product abuse, and human error in handling and processing of plastic molding and inserts is realized throughout the facility. Industry respected care and handling guidelines for sucker rod products are thereby forced into compliance via automation instead of requested to be held in compliance by human staffing.

Although the industry prefers plastics as lightweight, known consumables in the down-hole space for sucker rod, aluminum, brass, and steel could also be used to provided stabilizers for stabilizing the sucker rod in compressive moments. However, the cost, mass and material density of the stabilization member must be considered. Other variants of manufacturing capability include radial pultrusion coiled profile, which could then be twisted onto and around the sucker rod and bonded with an immersion-service adhesive, such as various grades of epoxy or methyl-methacrylate. Another alternative for the manufacturing of the helical stabilization tool can be radial extrusion variants also bonded with immersion service adhesives.

Thermoplastic straight extrusions of the continuous profile can be produced with post processing of heating and softening the polymeric material, mechanically yielding the thermoplastic material to helical form, and cooling. This manufacturing method would save on capital equipment costs; however, the stabilization tool's wear and temperature performance are limited in comparison to the preferred method thermoset molding with modular tooling Metallic sections could also be cast individually and bolted together around the sucker rod, creating a continuous profile from end to end.

Thermoset polymeric materials are not melt-processable, do not soften when heated, and are ideal for use in high pressure, high temperature applications such as down-hole oil-wells. Their use is not new and unique to down-hole applications, being accepted for down-hole use for nearly 50 years. For sucker rod stabilizers, from a processing, cost, and ease of manufacturability for long components along a sucker rod body, thermoset molding, particularly for glass and mineral reinforced thermoset phenolic resins, is an ideal candidate for the stabilization device. Plastic performance is stable, consistent, and notably outstanding as recognized by industry as long as manufacturing consistency is upheld. Material density and cost are proven cooperative with market requirements. The manufacturing and molding of thick cross-sections, though timely, is completely dense, with no pores or voids throughout the thick-walled parts.

Other suitable materials regularly accepted in the market place would be glass and mineral filled thermoplastic engineering resins, such as Nylon (PA), Poly-Phthal-Amide (PPA), Poly-Aryl-Ether-Ketone (PAEK), Poly-Ether-Ether-Ketone (PEEK), Poly-phenylene Sulfide (PPS), and Poly-Ketone (POK), or a mixture of the foregoing. Many of these materials are also offered without reinforcements, as the reinforcements have potential to be abrasive to the steel tubing. Thermoplastic materials are, however, melt-processable, are designed to soften and do soften when heated, and therefore lose strength, mechanical stability, and modulus, which are significant drivers for wear resistant materials. Because of this, the product life of thermoplastic materials in elevated temperature environments is limited. The molding process described in detail herein can be adapted for the injection of thermoplastic resins.

Other designed-in benefits with the helical design allow for 360-degree protection around the rod without inhibiting fluid flow. Based on market response and experience, the grade of production tubing (hardness of the steel) and the rod guide material used in centralizer application (abrasive fillers) may create wear tracks in the tubing. Some of these can also come from erosion or corrosion and fluid flow patterns around the guide profile and through the movement of the rod string within the tubing. 360-degree protection inhibits the concern of wear tracks from individual vanes within the tubing. Currently the market prefers the use of sucker rod rotators which slowly rotate the rod string as the surface pumping unit moves up and down. This is an acceptable practice to distribute wear evenly across the standard 4-vane sucker rod guide design. Wear rates are dependent on compressive loading between the plastic profile and the sucker rod and production tubing (side-load, as industry defines it through sucker rod string design programs) and in-turn, the surface area taking that compressive loading. An increase in bearing surface area (denominator) in contact with the tubing reduces this compressive pressure, reducing material wear rates. Because of this phenomenon, rod guide centralizer manufacturers with larger surface area vanes made from inferior thermoplastic materials may wear at an acceptable rate in comparison to a preferred thermoset phenolic material with vane of that which is less surface area. This creates a ratio of surface area to material properties which can be extrapolated and compared to various products theoretical wear life. Actual compressive stress on the sucker rod centralizer or stabilization tool vane divided by the Compressive Strength can provide a relative parameter from one product and material centralizer design to another. This would then assist in extrapolating theoretical product performance. Thermoplastic materials have a drastic loss of mechanical strength and integrity at elevated temperatures (FIG. 14); however, thermosets such as phenolic, do not realize this same loss in performance. A lower value for Stress-Strength Analysis allows for greater confidence in probability and reliability of the part in application. Operators desire the longest lasting sucker rod protection devices possible at an economical price and with stable, predictable performance.

Compressive Strength==value from datasheet, relative to application temperature $$\text{COMPRESSIVE STRESS } (PSI) = \frac{\text{SIDE LOAD FORCE (LBS)}}{\text{BEARING SURFACE AREA } (SQ.\text{ IN.})}$$

$$\text{Stress-Strength Analysis} = \frac{\text{Compressive Stress } (psi)}{\text{Compressive Strength } (psi)}$$

In addition to the bearing surface calculation as a result of studying the vane width from various rod guide centralizers versus the stabilization tool herein, another engineered benefit of the helical profile includes a drastic increase in bearing surface as the product wears down. Typical centralizers do see some improvement of bearing surface as the product wears, until its core diameter is found, and then the bearing surface area is substantially improved, although typically below the product life minimum diameter. The helical design engages more and more surface area as the product wears, allowing for a dynamically improving bearing surface area which reduces compressive pressure, further elongating the product life. This is a feature unique to the enclosed invention. See graphic below showing before and after with calculations related to the bearing surface area from one standard rod guide in comparison to the 360-degree helical sucker rod stabilizer.

Figures 24, 25:
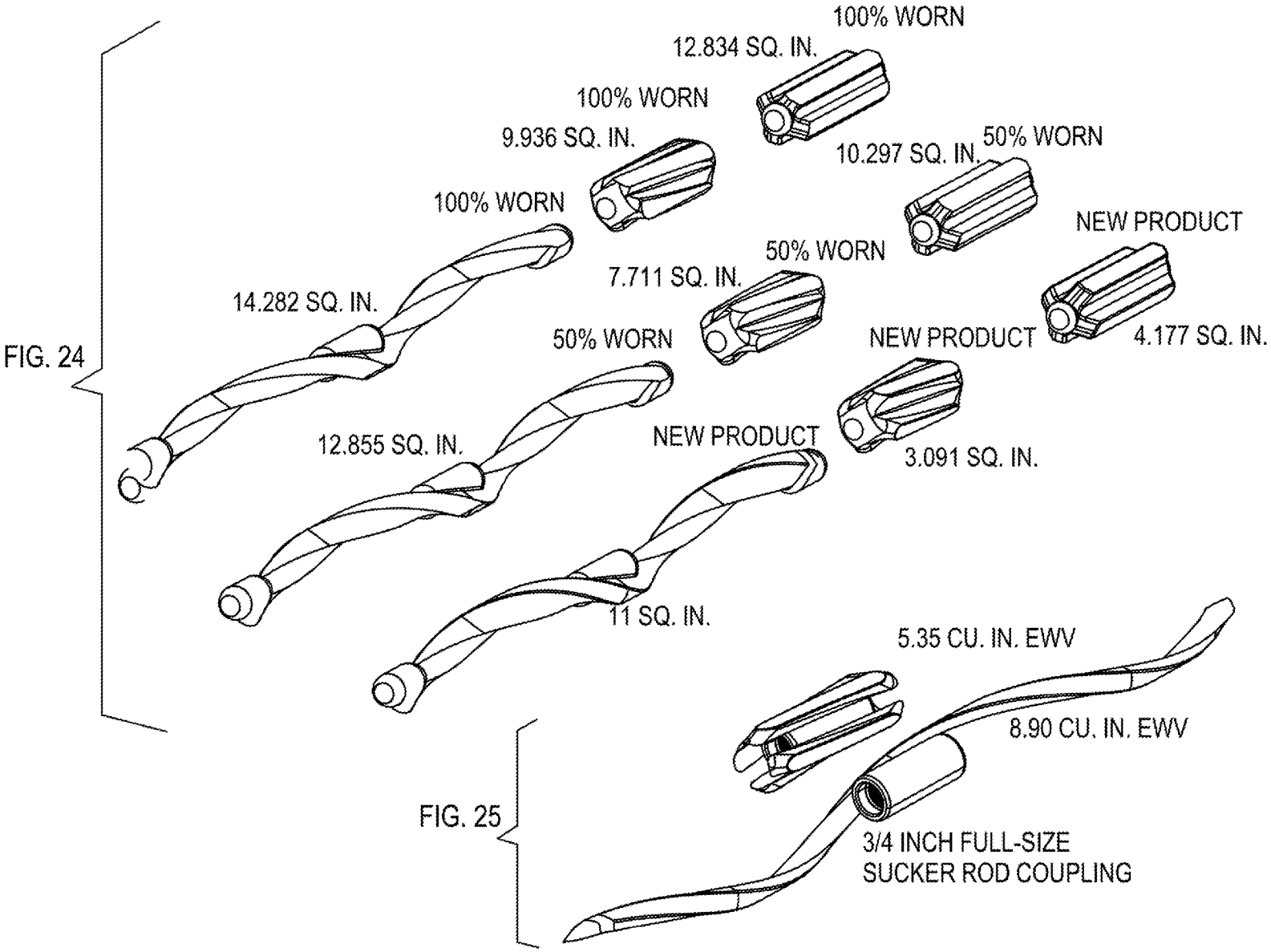

FIGS. 24 and 25 are perspective views illustrating the high erodible wear volume ("EWV") of the stabilizer of the present disclosure, as compared to the erodible wear volume of conventional prior art centralizers. FIG. 24 corresponds to the EWV for Table A and FIG. 25 corresponds to the EWV values listed in Table C below.

TABLE B

| | More Contact Surface Area is Better for Wear Resistance | | |
|---|---|---|---|
| | Surface Area, 100% New Product | Surface Area, 50% Worn Product | Surface Area, 0% End-of-Life Product |
| Helical Stabilizer | 11 sq. in. | 12.855 sq. in. | 14.282 sq. in. |
| Large Thermoplastic Market Offering | 4.177 sq. in. | 10.297 sq. in. | 12.824 sq. in. |
| Large Thermoset Market Offering | 3.091 sq. in. | 7.711 sq. in. | 9.936 sq. in. |

Manufactured in the preferred way with polymeric materials, the stabilization tool with inevitably experience wear against the steel tubing. This is by design as the stabilization tool shall not cause damage to the sucker rod or production tubing. The volume of material that can be worn away, in a traditional 4-fin centralizer design, is commonly referred in industry to "Erodible Wear Volume". That is, the volume of plastic that may erode away before a metal sucker rod or coupling can make contact to production tubing. The metric is skewed in industry, as it does not take into account the rates at which polymeric material composition wears. Therefore, comparing dissimilar materials by an EWV factor only is a shortsighted view for trying to create a comparative example for marketing and sales purposes.

For our review and with our intention to use thermoset resins as the material makeup of the single fin, helical wrap stabilization tool disclosed herein, EWV comparisons can be made between other thermoset phenolic centralizers to which the stabilization tool may find replacing, due to enhanced feature set of additional protection on the sucker rod. The enhanced features include the primary driver for the design of the product, stabilizing the sucker rod in compressive moments to prevent axial deflection and bending moments which result in rapid fatigue and failure of sucker rod.

TABLE C

| Product | EWV ($in^3$) |
|---|---|
| ¾" Sucker Rod Stabilization Tool | 8.90 $in^3$ |
| ¾" Legacy Thermoset Centralizer | 5.35 $in^3$ |

With more available EWV, the product has undoubtedly more wear life than that of a traditional 4-fin legacy thermoset sucker rod centralizer. Further, the material compositions are synonymous, and lastly, the bearing surface area discussed earlier further validates a stress-reduction on the plastic, which lowers its stress:strength ratio, leading to another factor which establishes exponential increase in product life unique to this invention.

Operators have concern with an increase in friction loading due to more plastic guides or surface area in contact with the inner surface of the production tubing; the load/force between the two materials does not change. An increase of surface area directly and proportionally reduces the pressure between the two surfaces, creating a negligible effect. No additional frictional loading will take place between abundant plastic to tubing contact and minimal plastic to tubing contact. The pound-force loading between the two is the same.

μ=Coefficient of Friction between plastic and steel, lubricated

μ=varies between 0.06 and 0.14, according to industry studies

Drag Load (lbs)=(μ)(Side-Load Force, lbs)

Coefficient of friction and drag load are not driven whatsoever by surface area touching the tubing. Instead, it is directly and only proportional to the side-load force and friction coefficient of the polymeric materials. An increase in centralizer material does reduce the compressive pressure (stress) on the materials therefore increasing its wear life. Ideally, product designers of centralizers would maximize surface area in contact with production tubing for a reduction of compressive pressure between the sucker rod and tubing without reducing fluid flow paths which can create an increase in fluid drag.

Distributed surface area across the tubing allows for a significant reduction in compressive stress and pressure between the centralization device and tubing, therefore furthering the life by reducing the erosion/wear of the centralizer material. If you consider a 50 lb. load applied on an abrasive sheet such as sandpaper, to a 12"×12" floor and the same load across a larger abrasive sheet on a 36"×36" floor, the load doesn't change, only surface area did. The abrasive and reduction of pressure, however, is less effective at removing material, therefore wear life increases. With an increase in surface area, you have reduced the pressure applied to the surface, which reduces the friction on a per unit basis, yet the frictional drag overall is the same.

The helical profile for the invention could be applied to the rod in one piece or multiple sections. To be effective, the rod shall be reinforced with the helical pitch, whether in sections or with one single continuous coil component, from end to end for the maximum effect and benefit related to the prevention of sucker rod buckling within the production tubing.

A simple analysis was conducted to validate the benefit of the helical profile from end to end versus rod guides attached in common configurations.

A summary table of the load values required to buckle the rod, assuming the guides cannot move in the Y or Z direction due to the production tubing constraint, is shown below:

TABLE D

| | FEA Buckling Analysis, modes | | | |
|---|---|---|---|---|
| Design | 1 | 2 | 3 | 4 |
| Traditional 4 Sucker Rod Guides Per Sucker Rod, Even Spacing | 1,755 lbf | 1,756 lbf | 3,556 lbf | 3,557 lbf |
| Traditional 8 Sucker Rod Guides Per Sucker Rod, Double Up Spacing | 6,835 lbf | 6,845 lbf | 8,285 lbf | 8,287 lbf |

TABLE D-continued

| | FEA Buckling Analysis, modes | | | |
|---|---|---|---|---|
| Design | 1 | 2 | 3 | 4 |
| Traditional 8 Sucker Rod Guides Per Sucker Rod, Even Spacing | 7,412 lbf | 7,422 lbf | 20,060 lbf | 20,078 lbf |
| 4 Component Helical Coil Stabilizers Per Sucker Rod, Even Spacing | 10,370 lbf | 10,380 lbf | 10,485 lbf | 10,478 lbf |
| 7 Component Helical Coil Stabilizers Per Sucker Rod, Even Spacing | 10,833 lbf | 11,034 lbf | 130,929 lbf | 134,068 lbf |

Regarding the design of the helical profile as having one vane instead of four vanes, this is done to maximize fluid flow bypass area across the helical profile and sucker rod body during the downward motion of the sucker rod string within the production tubing. Furthermore, the reduction to one-vane from four-vanes vastly changes the area moment of inertia (geometrical stiffness) of the stabilization tool. Often in application there is excessive stress created by sucker rod centralizers when sucker rods are put into compression. This occurs at the edges of the rod guides, bending moments, which lead to pre-mature sucker rod failure. Reducing the cross section of the molded profile and extending the length of the sucker rod protection devices is preferred. A simple comparison can be made with common lumber. A four-vane traditional sucker rod centralizer comes in a variety of materials; however, geometrically one could metaphorically compare it to a 4×4 wood post. This wood post, compared to the invention disclosed herein, is much more stiff than comparatively speaking a 2×2 post. Because the reduction of cross-sectional area is down by nearly 75%, the profile, although the same material, is much more flexible. This design approach is unheard of in the world of sucker rod centralizers or protection devices. The coiled profile with its reduction in AMOI, with the higher modulus phenolic reinforced material, is nearly 2× more flexible than the sucker rod itself, and up to seven times more flexible than traditional sucker rod guide/centralizer profiles of the same material. In order to create a traditional sucker rod guide profile with the same flexibility as the invention herein, the modulus E must be reduced by 7×. With polymer material science properties available, this would result in a material that is too soft to be wear resistant for suitable use in application. Of course, the operators and users of the sucker rod centralizers or stabilization products want the investment they made to last as long as possible without providing negative effects to the sucker rod for some auxiliary reason (too stiff). The material science and options of polymers for downhole use has plateaued due to technologies available today both on the thermoset and thermoplastic side of the market. The future of sucker rod protection lies with creative geometry as disclosed herein.

For instance:

$E$=modulus of elasticity $I$=area moment of inertia

Stiffness Matrix=$(E)(I)$

Common wear resistant sucker rod guide (XX direction):

$E$=2,400,000 psi $I$=0.775 $in^4$

Stiffness Matrix=($E$)($I$)=(2,400,000)(0.775)=1,860,000

¾" Sucker Rod:

$E$=29,700,000 psi $I$=0.0155 $in^4$

Stiffness Matrix=($E$)($I$)=(29,700,000)(0.0155)=461,287

Stabilization Tool disclosed herein:

$E$=2,400,000 psi $I$=0.11 $in^4$

Stiffness Matrix=($E$)($I$)=(2,400,000)(0.11)=264,000

Combining the stiffness of the geometry and the material modulus shows that the helical coil profile is nearly 2× more flexible in the XX direction evaluated, in comparison to the steel ¾" sucker rod.

To match the stiffness of the ¾" sucker rod yet provide the longest lasting, stable down-hole thermoset material, the maximum AMOI may be calculated:

$E_{steel}$=29,700,000 psi $E_{plastic}$=2,400,000 psi $I$=0.0155 $in^4$

Stiffness Matrix Comparison $$(E_{steel})(I_{steel})=(E_{plastic})(I_{plastic})$$

$$\frac{(E_{steel})(I_{steel})}{(E_{plastic})}=(I_{plastic})$$

$$\frac{(29{,}700{,}000)(0.0155)}{(2{,}400{,}000)}=0.191=(I_{plastic})$$

The AMOI range of common sucker rod guides varies but for typical 4-vane variants, is between 0.600 $in^4$-0.800 $in^4$.

Figure 26:
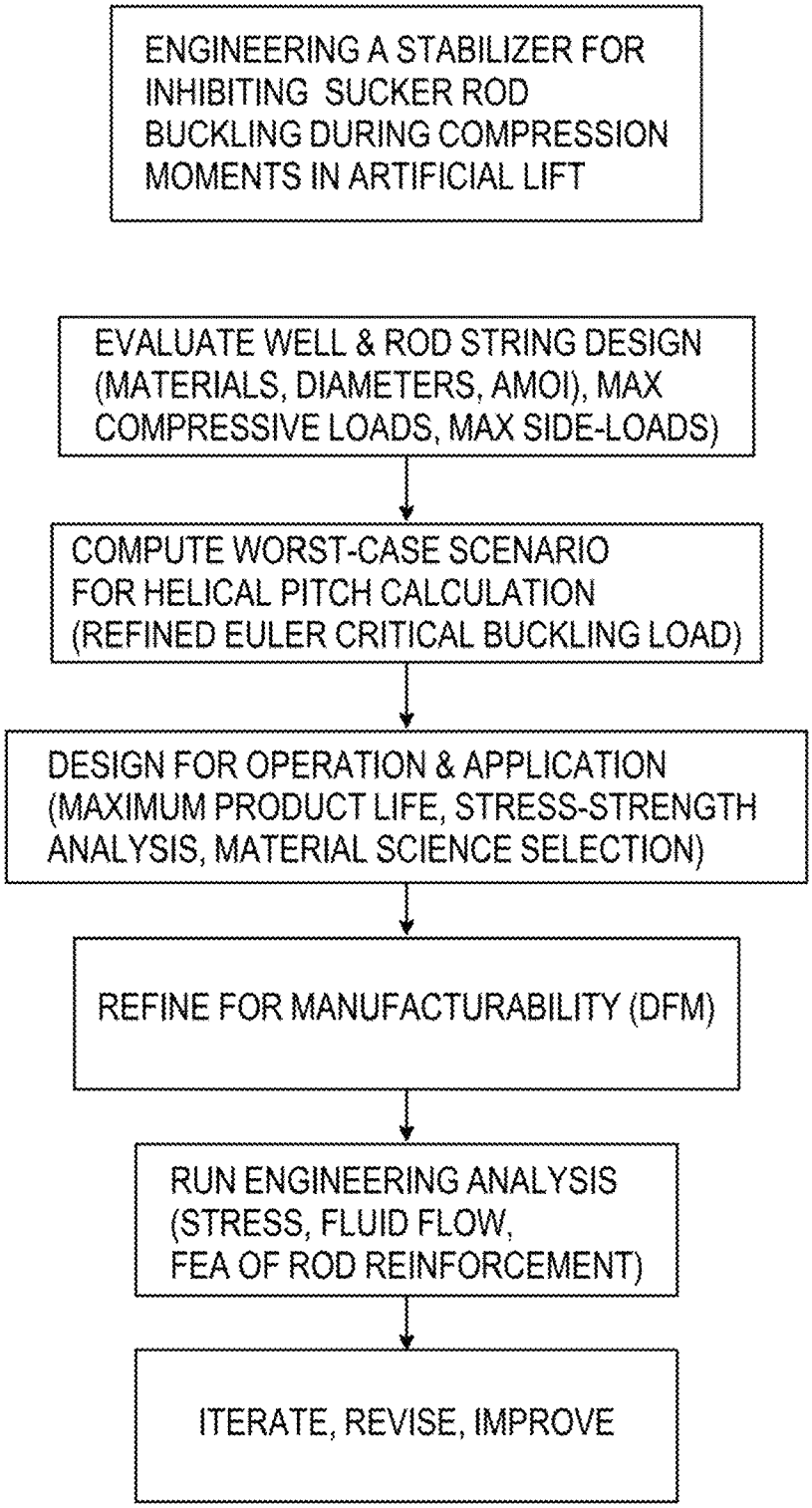

FIG. 26 illustrates a process for engineering a stabilizer according to the present disclosure, including inhibiting sucker rod buckling during compression moments in artificial lift wells. The various steps shown in FIG. 26 are followed as illustrated, and taking into account various design factors, including the following:

Design Factors for Polymeric Product Life:
Erodible Wear Volume
Bearing Surface Area
Material selection (material science, plastics are non-linear, thermosets are nearly linear) Ideal Factors Industry Use:
Impact Strength
Fluid Flow Bypass Area (cross-sectional area around the guide and sucker rod and inside of the production tubing
Fluid Turbulence—1-fin vs 4-fin allows for drastic increase in fluid bypass area
High EWV, Long lasting plastic in all temperatures
Buckling inhibition
Constant sucker rod reinforcement
No stress/bending moment at edge of rod guide
Manufacturing requirements:
Throughput, consistent manufacturing, quality
Traceability
Care and handling of customer sucker rod
New and Useful Benefits:
Geometric flexibility+long lasting plastic=longest and strongest sucker rod protection ever created
Unique design of plastic allows for minimal increase in material yet major increase in EWV, fluid flow area, and product flexibility Information/variables to be addressed or known to effectively design:
Calculate maximum spacing for stabilization tools:
Max compressive load (weight of rod string above rod in question)
Sucker rod material (modulus of elasticity)
Sucker Rod diameter (AMOI calculation)
Manufacturability
Material science and associated equipment for quality parts
Material science for polymer performance in well (Tg analysis)
Tooling design creativity for part release or variable lengths.
Cost of resin and associated labor costs
Product Analysis
EWV metrics from other market offerings
Stiffness matrix of other market offerings (modulus*AMOI)
Fluid Flow characteristics of other products
FEA of molded part with sucker rod.

Thus, the advantages of this invention provide a stabilizer for inhibiting sucker rod buckling during compression moments in artificial lift wells, reducing bending moments and stress, increasing the stability of sucker rods, increasing sucker rod fatigue life, and a modular tooling design as a method of manufacturing. The manufacturing method is also new and unique, providing extensive assurance and benefit to the end-users and operators as the quality and manufacturing system is in place for machine regulated manufacturing, removing an abundant amount of human error and interpretation which often causes sub-par or under-performing parts for the end-users and oilfield operators and production companies. The sucker rod is constantly reinforced through the engineered helical pitch to which the calculated critical buckling load exceeds that which is attainable in the production well. Centralizing the sucker rod throughout the body consistently from end to end instead of periodically like traditional use of sucker rod guides proves more effective and a healthier approach regarding down-hole dynamics of sucker rod pumping systems. The coiled profile is proven to be more flexible than the sucker rod due to the reduction in Area Moment of Inertia, not affecting the natural motion of the sucker rod due to geometrical stiffness. Instead, the sucker rod protection and anti-buckling behavior is created through the physical occupation of space between the sucker rod and the production tubing.

Although the preferred embodiment has been described in detail, it should be understood that various changes, substitutions, and alterations can be made therein without departing from the spirit and scope of the invention as defined by the appended claims.

What is claimed is:

1. A stabilizer and a sucker rod for use within production tubing, said stabilizer and sucker rod comprising:

a molded solid body formed of polymeric materials which defines said stabilizer, said molded solid body having a vane formed with a helically shaped profile which continuously extends around a longitudinal axis of said sucker rod, wherein said helically shaped profile of said vane angularly extends fully around said sucker rod;

said vane configured such that said helically shaped profile of said vane has a pitch which extends with a length disposed parallel to said longitudinal axis, with at least one wrap of said vane extending fully around said sucker rod, and said length of said pitch configured such that an outer surface of said vane engages said production tubing and prevents an adjacent section of said sucker rod from contacting said production tubing;

wherein a cross section of said vane which extends transverse to said longitudinal axis has a radial length extending between said outer surface of said vane and said exterior surface of said sucker rod, and a thickness which extends transverse to said radial length;

wherein an interior surface of said vane is sized to fit about an exterior of said sucker rod for retaining said vane in fixed position relative to said sucker rod; and wherein the stabilizer further comprises at least one collar that wraps fully and continuously around said sucker rod, and wherein said vane has a cross-section which is rectangular in shape, with arcuately shaped inward and outward ends.

2. The stabilizer and the sucker rod according to claim 1, wherein said thickness of said vane is substantially the same as the exterior diameter of said sucker rod.

3. The stabilizer and the sucker rod according to claim 1, wherein said molded solid body of said stabilizer is secured in fixed position relative to said sucker rod with an adhesive applied between said exterior surface of said sucker rod and said interior surface of said vane.

4. The stabilizer and the sucker rod according to claim 1, wherein interior surfaces of said vane and said at least one collar are sized for fitting about said sucker rod with an interference fit which retains said vane and said at least one collar in fixed position relative to said sucker rod.

5. The stabilizer and the sucker rod according to claim 4, further comprising an upper molded collar and a lower molded collar disposed on opposite terminal ends of said vane with said at least one collar disposed there-between, wherein said upper molded collar and said lower molded collar are sized for fitting about said exterior of said sucker rod for retaining said vane in fixed position relative to said sucker rod.

6. The stabilizer and the sucker rod according to claim 5, wherein interior surfaces of said vane, said at least one collar, said upper molder collar, and said lower molded collar are sized for fitting about an exterior of said sucker rod with an interference fit which retains said vane and said at least one collar in fixed position relative to said sucker rod.

7. The stabilizer and the sucker rod according to claim 1, wherein said vane and said at least one collar are formed of a solid polymeric material, over-molded onto said sucker rod, and an exterior periphery of said vane defines a wear surface for engaging an interior wall of the production tubing.

8. The stabilizer and the sucker rod according to claim 1, wherein said pitch provides constant reinforcement of the sucker rod, whereas reinforcement of sucker rods in a string are provided by use of multiple stabilizers.

9. The stabilizer and the sucker rod according to claim 1, wherein at least one collar is centrally disposed adjacent to and continuous with said vane, and wherein said at least one collar is shaped to wrap fully around said sucker rod with a shrink fit engagement, and said at least one collar having a cylindrical shape.

10. A stabilizer and a sucker rod for use within production tubing, said stabilizer and sucker rod comprising:

a molded solid body formed of polymeric materials which defines said stabilizer; said molded solid body having a vane formed with a helically shaped profile which continuously extends around a longitudinal axis of said vane, wherein said helically shaped profile of said vane angularly extends fully around said sucker rod, with said longitudinal axis of said vane disposed coaxial with a sucker rod longitudinal axis;

said vane configured such that said helically shaped profile of said vane has a pitch which extends with a length disposed parallel to said longitudinal axis, with at least one wrap of said vane extending fully around said sucker rod, and said length of said pitch configured such that an outer surface of said vane engages said production tubing and prevents an adjacent section of said sucker rod from contacting said production tubing;

wherein a cross section of said vane which is disposed perpendicular to said longitudinal axis has a radial length extending between said outer surface of said vane and said exterior surface of said sucker rod, and a thickness which extends perpendicular to said radial length; and said molded solid body further including at least one collar disposed in continuous relation to said vane, wherein interior surfaces of said vane and said at least one collar are sized to fit about an exterior of said sucker rod for retaining said vane and said at least one collar in fixed position relative to said sucker rod; and wherein interior surfaces of said vane and said at least one collar are sized to fit about an exterior of said sucker rod with an interference fit which retains said vane and said at least one collar in fixed position relative to said sucker rod, and said at least one collar wraps fully and continuously around said sucker rod.

11. The stabilizer and the sucker rod according to claim 10, wherein said molded solid body of said stabilizer is secured in fixed position relative to said sucker rod with an adhesive applied between said exterior surface of said sucker rod and said interior surface of said vane and said at least one collar.

12. The stabilizer and the sucker rod according to claim 10, further comprising an upper molded collar and a lower molded collar disposed on opposite terminal ends of said vane with said at least one collar disposed there-between, wherein said upper molded collar and said lower molded collar are sized to fit about said exterior of said sucker rod for retaining said vane in said fixed position relative to said sucker rod.

13. The stabilizer and the sucker rod according to claim 12, wherein interior surfaces of said vane, said at least one collar, said upper molder collar, and said lower molded collar are formed of a solid polymeric material which is over-molded onto said sucker rod, and sized to fit about an exterior of said sucker rod with an interference fit which retains said vane and said at least one collar in said fixed position relative to said sucker rod, and an exterior periphery of said vane defines a wear surface for engaging an interior wall of the production tubing.

14. The stabilizer and the sucker rod according to claim 10, wherein said pitch provides constant reinforcement of the sucker rod, whereas reinforcement of sucker rods in a string are provided by use of multiple stabilizers.

15. The stabilizer and the sucker rod according to claim 10, further comprising said vane having a cross-section which is rectangular in shape, with arcuately shaped inward and outward ends, and said thickness of said vane is the same as the exterior diameter of said sucker rod.

16. A stabilizer and sucker rod for use within production tubing, said stabilizer and sucker rod comprising:

a molded solid body formed of polymeric materials which is over-molded onto said sucker rod to define said stabilizer, said molded solid body having a vane formed with a helically shaped profile which continuously extends around a longitudinal axis of said vane, wherein said helically shaped profile of said vane angularly extends fully around said sucker rod, with said longitudinal axis of said vane disposed coaxial with a sucker rod longitudinal axis;

said vane configured such that said helically shaped profile of said vane has a pitch which extends with a length disposed parallel to said longitudinal axis, with at least one wrap of said vane extending fully around said sucker rod, and said length of said pitch configured such that an outer surface of said vane engages said production tubing and prevents an adjacent section of said sucker rod from contacting said production tubing;

wherein a cross section of said vane which is disposed perpendicular to said longitudinal axis has a radial length extending between said outer surface of said vane and said exterior surface of said sucker rod, and a thickness which extends perpendicular to said radial length;

said molded solid body further including an upper molded collar and a lower molded collar disposed on opposite terminal ends of said vane, and an intermediate collar disposed there-between, wherein said upper molded collar, said lower molded collar, and said intermediate collar are disposed in continuous relation to said vane, and have interior surfaces which engage said exterior of said sucker rod for retaining said vane in said fixed position relative to said sucker rod; and wherein said molded solid body is formed of a solid polymeric material; over-molded onto said sucker rod to provide said upper molded collar, said lower molded collar, said intermediate collar and said vane, with an exterior periphery of said vane providing a wear surface for engaging an interior wall of a production tubing.

17. The stabilizer and the sucker rod according to claim 16, wherein said molded solid body of said stabilizer is secured in fixed position relative to said sucker rod with an adhesive applied between said exterior surface of said sucker rod and said interior surface of said vane, said upper molded collar, said lower molded collar, and said intermediate collar.

18. The stabilizer and sucker rod according to claim 16, wherein interior surfaces of said vane, said upper molded collar, said lower molded collar, and said intermediate collar are sized to fit about an exterior of said sucker rod with an interference fit which retains said vane, said upper molded collar, said lower molded collar, and said intermediate collar in fixed position relative to said sucker rod, and said intermediate collar wraps fully and continuously around said sucker rod.

19. A stabilizer for sucker rod for use within production tubing, said stabilizer comprising:

a molded solid body formed of polymeric materials which defines said stabilizer; said molded solid body having a helical vane having inner and outer surfaces and continuously extending around the sucker rod, wherein the helical vane is configured such that the outer surface of the helical vane will engage the production tubing to prevent the sucker rod from contacting the production tubing and wherein the inner surface of the helical vane is configured to engage the sucker rod;

upper and lower collars molded to the sucker rod and disposed on opposite terminal ends of the helical vane; and an intermediate collar disposed between the upper and lower collars, wherein the upper, lower and intermediate collars are designed to retain the helical vane in a fixed position on the sucker rod.

20. The stabilizer of claim 19, wherein the inner surfaces of the helical vane, the upper and lower collars, and the intermediate collar have an interference fit with the sucker rod such that the stabilizer is retained in a fixed position relative to the sucker rod.

21. The stabilizer of claim 19, wherein the intermediate collar wraps fully and continuously around the sucker rod and the helical vane has a rectangular cross-section and arcuately shaped inward and outward ends.

22. The stabilizer of claim 19, wherein the intermediate collar is centrally disposed adjacent to and continuous with the helical vane, wherein the intermediate collar is shaped to wrap fully around the sucker rod with a shrink fit engagement, and wherein the intermediate collar has a cylindrical shape.

23. A stabilizer for sucker rod for use within production tubing, said stabilizer comprising:

a molded solid body formed of polymeric materials which defines said stabilizer; said molded solid body comprising:

a helical vane formed of polymeric materials having inner and outer surfaces and continuously extending around the sucker rod, wherein the helical vane is configured such that the outer surface of the helical vane will engage the production tubing to prevent the adjacent sucker rod from contacting the production tubing and wherein the inner surface of the helical vane is configured to engage the sucker rod;

a collar having inner and outer surfaces and disposed in continuous relation to the helical vane, wherein the inner surfaces of the helical vane and the collar are sized to fit around the exterior of the sucker rod with an interference fit which retains the helical vane and the collar in fixed position relative to the sucker rod and wherein the collar wraps fully and continuously around the sucker rod.

24. A stabilizer for sucker rod for use within production tubing, said stabilizer comprising:

a molded solid body formed of polymeric materials which defines said stabilizer; said molded solid body comprising:

a helical vane formed of polymeric materials having inner and outer surfaces and continuously extending around the sucker rod, wherein the helical vane is configured such that the outer surface of the helical vane will engage the production tubing to prevent the adjacent sucker rod from contacting the production tubing and wherein the inner surface of the helical vane is configured to engage the sucker rod;

a plurality of collars having inner and outer surfaces and disposed in continuous relation to the helical vane, wherein the inner surfaces of the helical vane and the collars are sized to fit around the exterior of the sucker rod with an interference fit which retains the helical vane and the collar in fixed position relative to the sucker rod and wherein the collar wraps fully and continuously around the sucker rod.

25. The stabilizer of claim 24 wherein the inner surfaces of the helical vane and the collars are formed of solid polymeric material which is over-molded onto the sucker rod, and wherein the outer surface of the helical vane defines a wear surface for engaging the production tubing.

* * * * *